US007126565B2

(12) United States Patent
Kawasaki et al.

(10) Patent No.: US 7,126,565 B2
(45) Date of Patent: Oct. 24, 2006

(54) CURRENT SIGNAL OUTPUT CIRCUIT AND DISPLAY APPARATUS AND INFORMATION DISPLAY APPARATUS USING THE CURRENT SIGNAL OUTPUT CIRCUIT

(75) Inventors: Somei Kawasaki, Saitama (JP); Masami Iseki, Kanagawa (JP)

(73) Assignee: Canon, Kabushiki Kaisha, Tokyo (JP)

( * ) Notice: Subject to any disclaimer, the term of this patent is extended or adjusted under 35 U.S.C. 154(b) by 364 days.

(21) Appl. No.: 10/650,776

(22) Filed: Aug. 29, 2003

(65) Prior Publication Data

US 2004/0104909 A1 Jun. 3, 2004

(30) Foreign Application Priority Data

Sep. 2, 2002 (JP) ..... 2002-256432
Aug. 28, 2003 (JP) ..... 2003-305081

(51) Int. Cl.
*G09G 3/30* (2006.01)

(52) U.S. Cl. ..... 345/76; 345/211; 315/169.1

(58) Field of Classification Search ..... 345/76, 345/82, 204, 211, 169.4; 315/169.1, 169.3, 315/169.4
See application file for complete search history.

(56) References Cited

U.S. PATENT DOCUMENTS 5,675,278 A * 10/1997 Tanaka et al. ..... 327/333
5,748,026 A * 5/1998 Maekawa et al. ..... 327/333
6,229,506 B1 * 5/2001 Dawson et al. ..... 345/82
6,373,454 B1 4/2002 Knapp et al. ..... 345/76
6,501,466 B1 * 12/2002 Yamagishi et al. ..... 345/204
6,580,408 B1 * 6/2003 Bae et al. ..... 345/76

FOREIGN PATENT DOCUMENTS

JP 10-74060 3/1998

* cited by examiner

*Primary Examiner*—Richard Hjerpe
*Assistant Examiner*—Kimnhung Nguyen
(74) *Attorney, Agent, or Firm*—Fitzpatrick, Cella, Harper & Scinto

(57) ABSTRACT

A current signal output circuit includes a first switch, a first capacitor element and a first transistor in which a first terminal of the first switch is connected to a voltage signal line for providing a voltage signal. A second terminal of the first switch is connected to a first terminal of the first capacitor element, a second terminal of the first capacitor element is connected to a gate electrode of the first transistors, and a first main electrode of the first transistor is connected to a first power source.

31 Claims, 16 Drawing Sheets t1
t2
t3
t4
t5
t6
t7
t8
t9
t10
t11
t12
t13
t14
t15
t16
t17
t18
Fig.2A Video
d1
d2
d3
Vb1
Fig.2B SPa
Fig.2C P1
Fig.2D P2
Fig.2E P3
Fig.2F M3/G
Va1
ΔV1
Va2
ΔV3
Va3
Fig.2G SPb
Fig.2H P4
Fig.2I P5
Fig.2J P6
Vb1
Fig.2K M9/G
ΔV2
Ib1
Fig.2L i (data)
Ia1
Ia2
Ib2 t1
t2 t3
t4
t5 t6
t7
t8 t9
d1
d2
d3

REF

Video

SPa

P11

SPb

P12 t1
t2
t3
t4
t5
t6
t7
t8
t9
t10
t11
t12
Vb1
d1
d2
d3
Video
SP
P13
P14
P15

CURRENT SIGNAL OUTPUT CIRCUIT AND DISPLAY APPARATUS AND INFORMATION DISPLAY APPARATUS USING THE CURRENT SIGNAL OUTPUT CIRCUIT

BACKGROUND OF THE INVENTION

1. Field of the Invention

The present invention relates to a current signal output circuit for outputting a current signal. Further, the invention relates to a display apparatus using the current signal output circuit.

2. Related Background Art

Various display apparatus have been known as background arts. As an example of the display apparatus, there is a display apparatus using an electroluminescence element. The example is described in U.S. Pat. No. 6,373,454.

OBJECT AND SUMMARY OF THE INVENTION

The inventor of the application has investigated various constitutions as constitutions of display apparatus.

An explanation will be given of a constitution which has been investigated as a display apparatus using an electroluminescence element as follows.

An electroluminescence (EL) element is applied to a panel type image display system (hereinafter, referred to as EL panel) in which pixel display circuits generally constituted by TFTs are aligned two-dimensionally. As luminescence setting systems of the EL element, a voltage setting system and a current setting system can be pointed out.

<EL Panel by Voltage Setting System>

FIG. 12 shows a circuit constitution of a colored EL panel by a voltage setting system.

An input image signal 10 is pertinently inputted to column control circuits 22 provided by a number three times as much as a horizontal pixel number of an EL panel provided for each color of red, green and blue (RGB). Further, a horizontal scanning control signal 1*a* is inputted to an input circuit 6 to output a horizontal scanning control signal 11 and the horizontal control scanning control signal 11 is inputted to a horizontal shift register 3 comprising registers of the horizontal pixel number. The horizontal scanning control signal 11 comprises a horizontal clock signal and a horizontal scanning start signal. Further, a horizontal sampling signal group 17 outputted from respective terminals of the horizontal shift register 3 is inputted to the respectively assigned column control circuits 22.

As shown in FIG. 14, the constitution of the column control circuit 22 is constructed by a very simple constitution in which a horizontal sampling signal SP is connected to M100/G, an input image signal video (here, one of RGB) is connected to M100/S and an image voltage data v (data) which is a column control signal 14 is outputted from M100/D.

Further, in the specification, for convenience of explanation, a gate electrode, a source electrode and a drain electrode of the transistor are respectively designated by abbreviated notations of /G, /S and /D and a signal and a signal line for supplying the signal are expressed without being differentiated from each other.

At an image display region 9, pixel circuits 2 respectively having equivalent constitutions are arranged two-dimensionally and respectively assigned to drive EL display elements of RGB and display of one pixel is assigned to a set of three pieces of the pixel circuits 2.

Image voltage data v (data) outputted from the column control circuit 22 is inputted to a group of the pixel circuits 2 arranged on the same column. Further, a vertical scanning control signal 12*a* outputs a vertical scanning control signal 12 via an input circuit 7 and the vertical scanning control signal 12 is inputted to a vertical shift register 5 including registers of a number equal to a vertical pixel number of the EL panel. The vertical scanning control signal 12 consists of a vertical clock signal and a vertical scanning control signal. Further, a row control signal 20 outputted from each of output terminals of the vertical shift register is inputted to the pixel circuits 2 arranged on the same row.

(Pixel Circuit of Voltage Setting System)

FIG. 13 shows a constitution of the pixel circuit 2 of the voltage setting system.

The voltage data v (data) is connected to M300/S. Further, the row control signals 20 correspond to P13, P14 and P15 and respectively connected to M300/G, M200/G and M400/G. M300/D is connected to a capacitor C200 and the capacitor C200 is connected to M100/G the source of which is connected to a power source and a capacitor C100. Further, M100/D and M100/G are respectively connected to M200/D and M200/S, M100/D is connected to M400/S, and M400/D is connected to a current injecting terminal of an EL element one end of which is grounded.

Next, an explanation will be given of operation of the EL panel of FIG. 12 in reference to time charts of FIGS. 15A, 15B, 15C, 150 and 15E. FIG. 15A indicates the input image signal video, FIG. 15B indicates a horizontal sampling signal SP and FIGS. 15C, 15D and 15E indicate row control signals P13 through P15 of a corresponding row. Further, FIGS. 15A, 15B, 15C, 15D and 15E indicate three horizontal periods, that is, three row periods.

First, at time t1 through t2 in a horizontal blanking period of the input image signal, each horizontal sampling pulse SP is simultaneously changed to H level and at this occasion, blanking voltage which is the input image signal is made to constitute the column control signal 14. Further, in SP of FIG. 15B, the horizontal sample signal of the corresponding row is designated by a bold line.

Before Time t5 (Luminescence Holding Period)

At time t1 through t5 , the row control signals P13 through P15 of the pixel circuit 2 of the corresponding row are respectively brought into H level, H level and L level and even when each horizontal sampling pulse SP is simultaneously changed to H level at time t1 through t2 , M200, M300 and M400 of the pixel circuit 2 respectively stay to be OFF, OFF and ON an therefore, drain current of M100 determined by the capacitor C100 and voltage of M100/G of the pixel circuit 2 which is hold voltage of the gate capacitance is injected to the EL element and luminescence is continued. Further, at time t1 through t2 during the horizontal blanking period, voltage of the input image signal video is voltage Vb1 at a vicinity of a black level as shown in FIG. 15A.

Time t5 Through t9 (Luminescence Setting Period)

At time t5 , the row control signals P13 and P15 of the corresponding row change to L level and H level. At time t5 through t6 , each horizontal sampling pulse SP is simultaneously changed to H level again and at this occasion, the blanking voltage which is the input image signal is made to constitute the column control signal 14.

At this occasion, in the pixel circuit 2 of the corresponding row shown in FIG. 13, M400 is made OFF, current is not supplied to the EL element and therefore, the EL element is switched off. Further, M200 and M300 are respectively made ON and brought into an ON state and therefore, the capacitors C100 and C200 and the gate capacitance of M100 are operated to discharge such that voltage of (VCC−M100/G) becomes proximate to threshold voltage Vth of M100 and therefore, drain current of M100 is reset to a very small value. Further, also at time t5 through t6 during the horizontal blanking period, voltage of the input image signal video is voltage Vb1 at a vicinity of black level similar to that at time t1 through t2 as shown in FIG. 15.

At time t6, although SP and P14 respectively become L level and H level, the voltage of (VCC−M100/G) of the pixel circuit 2 successively stays to be the threshold voltage Vth of M100.

At time t7 through t8, SP of the corresponding row becomes H level and an input image signal value d2 at this time is inputted to the pixel circuit 2 as v (data). At this time, voltage of M100/G of the pixel circuit 2 is changed by voltage ΔV. The voltage ΔV is generally shown by Equation (1).

$$\Delta V=-d2\times C200\div(C200+C100+C(M100)) \quad (1)$$

where C(M100) designates the gate input capacitance of M100 in the pixel circuit 2.

At time t8, SP is changed again to L level, the change of the voltage M100/G shown by Equation (1) is held and the state is maintained until time t9.

At and after t9 (Luminescence Holding Period)

At time t9, P13 and P15 are changed again to H level and L level respectively and M300 and M400 of the pixel circuit 2 are respectively brought into OFF and ON states. Drain current of M100 determined by voltage of M100/G of the pixel circuit which has been change in this way is applied to the EL element, a change in a luminescence amount is brought about and the state is maintained.

Although during time t9 through t10 and time t11 through t12 , the corresponding SP signal is changed to H level, since M300 of the pixel circuit 2 is made OFF, the luminescence operation of the EL element is not influenced thereby.

Equation (1) signifies that the luminescent amount can be set by the voltage value (d2) constituting a reference by Vb1 during the horizontal blanking period of the input image signal video. The drain current Id of M100 of the pixel circuit 2 can generally be shown by Equation (2).

$$Id=\beta\times\Delta V2 \quad (2)$$

The EL element basically carried out the luminescence operation in proportion to injected current and therefore, at the EL panel of the voltage setting system shown in FIG. 12 it is known from Equation (2) that the luminescence amount of the EL element of each pixel can be controlled by a value in proportion to a square of the input image signal level constituting the reference by the blanking voltage. At the EL panel of the voltage setting system, a circuit constitution of a liquid crystal panel having positive achievement can be applied thereto except the pixel circuit 2.

<EL Panel by Current Setting System>

FIG. 3 shows a circuit constitution of a colored EL panel by a current setting system. First, an explanation will be given of a difference from the EL panel by the voltage setting system of FIG. 12.

An auxiliary column control signal 13*a* outputs an auxiliary column control signal 13 via an input circuit 8 and the auxiliary column control signal 13 is inputted to gate circuits 4 and 16. Further, the horizontal sampling signal group 17 outputted to the respective terminals of the horizontal shift register 3 are inputted to a gate circuit 15 and a converted horizontal sampling signal group 18 is inputted to a column control circuit 1. The gate circuit 15 is inputted with a control signal 21 outputted from the gate circuit 16. The column control circuit 1 is inputted with a control signal 19 outputted from the gate circuit 4.

(Column Control Circuit)

FIG. 8 shows the constitution of the column control circuits 1 aligned by a number the same as a horizontal pixel number of the EL panel of the current setting system.

Input image information is constituted by the input image signal video and a reference signal REF which are respectively inputted to M100/S, M200/S and as well as M500/S and M600/S. Further, the horizontal sampling signal group 18 outputted from the gate circuits 15 respectively comprise SPa and SPb and connected to M100/G, M500/G as well as M200/G, M600/G of the column control circuit 1. Further, M100/D, M200/D, M500/D and M600/D are respectively connected with capacitors C100, C200, C300 and C400 and connected with M300/S, M400/S, M700/S and M800/S. The control signal 19 is constituted by P11 and P12 which are respectively connected to M300/G, M700/G as well as M400/G, M800/G. M300/D and M400/D as well as M700/D and M800/D are respectively connected to each other and inputted to a voltage to current conversion circuit gm as v (data) and v (REF). Further, the voltage to current conversion circuit gm is inputted with a reference current setting bias VB and outputs a current signal i (data) used as the column control signal 14.

FIG. 10A shows an example of a constitution of the voltage to current conversion circuit. Although an explanation thereof will be omitted since the basic operation is general, when, for example, a 200 ppiEL panel is assumed in an EL panel aiming at power conservation as a point of taking a consideration thereto, current injected to the EL element of each pixel is small and maximum current is assumed to be 100 nA significantly smaller than 1 μA. In order to achieve the voltage to current conversion characteristic as linear as possible under the condition, it is necessary to reduce a current drive function by reducing a W/L ratio of the gate region of M200, M300.

FIG. 10B shows the voltage to current conversion characteristic of FIG. 10A. According to the voltage to current conversion circuit of FIG. 10A, it is difficult to carry out a design in which minimum current 11 (black current) at minimum voltage V1 (black level) is constituted by zero current. When the black current 11 cannot be constituted by the zero current, contrast which is important as the image display panel cannot be ensured.

FIG. 11A shows an example of a constitution of the voltage to current conversion circuit taking a measure of this point. Respective drain terminals of first source-coupled circuits M200 and M300 are connected with M600 and M700 in which respective sources thereof are grounded and drains and gates are shortcircuited. Further, there is provided M800 operated as a second reference current source in which a source thereof is connected to a power source and a gate thereof is connected to the reference current bias VB, M800/D is connected to second source-coupled circuits M900 and M1000 and M900/G and M1000/G are respectively connected to M700/D and M600/D. Further, a current signal i (data) constituting the column control signal 14 is outputted from M1000/D via a current mirror circuit of M400 and M500 similar to the voltage to current conversion circuit of FIG. 10A. In FIG. 11A, in order to reduce a current drive function of M600 and M700 smaller than that of M900 and M1000, a W/L ratio of a gate region of M600 and M700 is made to be smaller than W/L ratio of a gate region of M900 and M1000.

FIG. 11B shows a voltage to current conversion characteristic of the voltage to current conversion circuit as shown in FIG. 11A which has been designed in this way. Not only the black current I1 at the black level V1 can be reduced but also the voltage to current conversion characteristic can be realized without deteriorating the linearity.

An explanation will be given of operation of the column control circuit in reference to time charts of FIGS. 9A, 9B, 9C, 9D, 9E and 9F.

At the time t1, control signals P11 and P12 are respectively changed to L level and H level.

During an effective period of the input image signal at time t1 through t4, the horizontal sampling signal group SPa is generated. At the time t2 through t3, SPa of the corresponding column is generated and video and REF at this time point are sampled to the capacitors C100 and C300 and held at and after time t3.

At time t4, the control signals P11 and P12 are respectively changed to H level and L level and (v(data)−v(REF)) inputted to the voltage to current conversion circuit becomes d1 and the current signal i (data) is outputted as the column control signal 14 during time t4 through t7 based on image signal inputted at time t2 through t3.

During the effective period of the input image signal at time t4 through t7, the horizontal sampling signal group SPb is generated, at time t5 through t6, SPb of the corresponding column is generated, inputs video and REF at the time point are sampled to the capacitors C200 and C400 and held at and after t6.

At time t7, the control signals P11 and P12 are respectively changed again to L level and H level, (v(data)−v(REF)) inputted to the voltage to the current to voltage conversion circuit becomes d2 and the current signal i (data) is outputted as the column control signal 14 during one horizontal scanning period from time t7 based on image information inputted at time t5 through t6.

During the effective period of the input image signal of the one horizontal scanning period from time t7, the horizontal sampling signal group SPa is generated again, at time t8 through t9 , SPa of the column is generated and the inputs video and REF at the time point are sampled to the capacitors C200 and C400 and held at and after time t9.

By repeating the above-described operation, current signal i (data) which is the column control signal 14 is converted to a line successive signal updated at every horizontal scanning period of the input image signal video.

(Pixel Circuit of Current Setting System)

FIG. 6 is an example of a constitution of the pixel circuit 2 of the current setting system. P9 and P10 correspond to the row control signal 20, the current signal i (data) is inputted as the column control signal 14 and M100/D is connected to a current injecting terminal of the grounded EL element.

The operation will be explained in reference to time charts of FIGS. 7A, 7B and 7C. At and before time t0 , P9 and P10 of the corresponding m-th row are at H level and therefore, both of M300 and M400 are made OFF, current is injected to the EL element by voltage of M100/G determined by charge voltage held at the capacity C100 and the gate capacitance of M100 and the EL element becomes luminescent in accordance therewith.

At time t0 , both of P9 and P10 of the corresponding row are changed to L level and the current signal i (m) of the m-th row is determined. That is, both of M300 and M400 are made ON and therefore, the current signal i (m) is supplied to M200, voltage of M200/G is set in accordance therewith, the capacitor C100 and the gate capacitances M100 and M200 are charged and current in correspondence with the current signal i (m) starts to be injected to the corresponding EL element.

At time t1 at which the current signal i (m) is determined, P10 is changed to H level, M300 is brought into an OFF state and the operation of setting the voltage of M200/G is finished and shifted to the holding operation. At time t2 , P9 is also changed to H level to thereby stop supplying current to M200, however, the voltage of M200/G set by the current signal i (m) stays to be held, the EL element is reset by injected current which is successively reset and the luminescence is continued.

FIG. 4 shows an example of other constitution of the pixel circuit 2 of the current setting system. P7 and P8 correspond to the row control signal 20, the current signal i (data) is inputted as the column control signal 14 and M400/D is connected to the current injecting terminal of the grounded EL element.

The operation will be explained in reference to time charts of FIGS. 5A, 5B and 5C. At and before time t0 , P7 and P8 of the corresponding m-th row are respectively at L level and H level and therefore, both of M200 and M300 are made OFF and M400 is made ON and therefore, current is injected to the EL element by voltage of M100/G determined by charge voltage held at the capacitor C100 and the gate capacitance M100 and the EL element becomes luminescent in accordance therewith.

At time t0 , P1 and P8 of the corresponding row respectively change to H level and L level and the current signal i (m) of the m-th row is determined. Both of M200 and M300 are made ON and M400 is made OFF and therefore, current stops to be injected to the EL element of the corresponding row and the EL element of the corresponding row is switched off. Further, the current signal i (m) is supplied to M100 and therefore, voltage of M100/G is set in accordance therewith and the capacitor C100 and the gate capacitance of M100 are charged.

At time t1 at which the current signal i (m) is determined, P8 is changed to H level again and M200 is brought into an OFF state and the operation of setting the voltage of M100/G is finished and shifted to the holding operation.

At time t2 , P7 is changed to L level to thereby stop supplying current to M100 and M400 is made ON, drain current of M100 set by voltage of M100/G is injected to the corresponding EL element and the EL element starts luminescence which is reset at and before time t1 in accordance therewith and continues luminescence until the luminescence is set again.

Based on the above-described result of investigation, it is a problem of the application to realize a novel current signal output circuit which has not been known, particularly realize a current signal output circuit providing an output restraining dispersion. Further, it is a problem thereof to realize a display apparatus having small nonuniformity of display by using the current signal output circuit.

An aspect of the invention of a current signal output circuit according to the application is constituted as follows. That is, the aspect is constituted by a current signal output circuit for outputting a current signal in accordance with an inputted voltage signal comprising:

a current signal control circuit, the current signal control circuit comprising:

at least a first through a sixth switch, a first and a second capacitor element and a first and a second transistor;

wherein a first terminal of the first switch is connected to a voltage signal line for providing a voltage signal, a second terminal of the first switch is connected to a first terminal of the first capacitor element, a second terminal of the first capacitor element is connected to a gate electrode of the first transistor, a first terminal and a second terminal of the third switch are respectively connected to the gate electrode and a second main electrode of the first transistor, a first main electrode of the first transistor is connected to a first power source, the second main electrode of the first transistor is connected to a first terminal of the fourth switch, a first terminal of the second switch is connected to the voltage signal line for providing the voltage signal and a second terminal of the second switch is connected to a first terminal of the second capacitor element, a second terminal of the second capacitor element is connected to a gate electrode of the second transistor, a first terminal and a second terminal of the fifth switch are respectively connected to a gate electrode and a second main electrode of the second transistor, a first main electrode of the second transistor is connected to the first power source, the second main electrode of the second transistor is connected to a first terminal of the sixth switch, second terminals of the fourth and the sixth switches are connected to each other to constitute a current signal output terminal for outputting the current signal, and control terminals of the first through the sixth switches are respectively connected to a first through a sixth control signal line.

Further, according to the application, the first terminal and the second terminal of the switch signifies two terminals conduction therebetween of which is controlled by the switch and conduction of the switch is controlled by the control signal inputted to the control terminal of the switch. Further, the first main electrode or the second main electrode of the transistor represents either of the two electrodes other than the gate electrode, that is, the source electrode and the drain electrode. Further, the first terminal or the second terminal of the capacitor element only indicates each of the two terminals of the capacitor element for convenience and is not provided with particularly differentiating significance.

Another aspect of the invention of a current signal output circuit according to the application is constituted as follows. That is, the aspect is constituted by a current signal output circuit for outputting a current signal in accordance with an inputted voltage signal comprising:

a current signal control circuit, the current signal control circuit comprising:

at least a first through an eighth switch, a first and a second capacitor element and a first through a fourth transistor;

wherein a first terminal of the first switch is connected to a voltage signal line for providing the voltage signal and a second terminal of the first switch is connected to a first terminal of the first capacitor element, a second terminal of the first capacitor element is connected to a gate electrode of the first transistor, a first terminal and a second terminal of the third switch are respectively connected to the gate electrode and a second main electrode of the first transistor, a first main electrode of the first transistor is connected to a first power source, the second main electrode of the first transistor is connected to a first terminal of the fourth switch and a first terminal of the seventh switch, a second terminal of the seventh switch is connected to a first main electrode of the third transistor, a gate electrode and the first main electrode or a second main electrode of the third transistor are shortcircuited and the second main electrode is connected to a second power source, a first terminal of the second switch is connected to the voltage signal line for providing the voltage signal, a second terminal of the second switch is connected to a first terminal of the second capacitor element, a second terminal of the second capacitor element is connected to a gate electrode of the second transistor, a first terminal and a second terminal of the fifth switch are respectively connected to the gate electrode and a second main electrode of the second transistor, a first main electrode of the second transistor is connected to the first power source, the second main electrode of the second transistor is connected to a first terminal of the sixth switch and a first terminal of the eighth switch, a second terminal of the eighth switch is connected to a first main electrode of the fourth transistor, a gate electrode and the first main electrode or a second main electrode of the fourth transistor are shortcircuited and the second main electrode is connected to a second power source, second terminals of the fourth and the sixth switches are connected to each other to constitute a current signal output terminal for outputting the current signal to outside, and control terminals of the first through the eighth switches are respectively connected to a first through an eighth control signal line.

Specifically, it is preferable when a time period for conducting both of the third switch and the seventh switch are conducted and/or a time period for conducting both of the fifth switch and the eighth switch are present.

Further, the following can be pointed out as another aspect of the invention of a current signal output circuit according to the application. That is, the aspect is a current signal output circuit for outputting a current signal in accordance with an inputted voltage signal characterized in comprising:

a current signal control circuit, the current signal control circuit comprising:

at least a first and a third switch, a first capacitor element, and a first transistor;

wherein a first terminal of the first switch is connected to a voltage signal line for providing the voltage signal, a second terminal of the first switch is connected to a first terminal of the first capacitor element, a second terminal of the first capacitor element is connected to a gate electrode of the first transistor, a first terminal and a second terminal of the third switch are respectively connected to the gate electrode and a second main electrode of the first transistor, and a first main electrode of the first transistor is connected to a first power source.

In this case, there can preferably be adopted a constitution in which the gate electrode of the first transistor is charged via the third switch and discharged such that a voltage of the gate electrode of the first transistor becomes proximate to a threshold voltage and thereafter, the gate electrode of the first transistor is charged to a voltage in accordance with the voltage signal provided to the first switch and the current signal in accordance with the charged state is outputted from the second main electrode as the current signal. Further, there can preferably be adopted a constitution in which a current supply path for charging the gate electrode of the first transistor is connected to the second terminal of the third switch via the third switch. There can preferably be adopted a constitution further including a switch for controlling current flowing to the current supply path.

Another aspect of the invention of a current signal output circuit according to the application is constituted as follows. That is, the aspect is constituted by a current signal output circuit for outputting a current signal in accordance with an inputted voltage signal comprising:

a current signal control circuit, the current signal control circuit comprising:

at least a first switch, a first capacitor element and a first transistor;

wherein a first terminal of the first switch is connected to a voltage signal line for providing the voltage signal, a second terminal of the first switch is connected to a first terminal of the first capacitor element, a second terminal of the first capacitor element is connected to a gate electrode of the first transistor, and the first main electrode of the first transistor is connected to a first power source.

In this case, there can preferably be adopted a constitution in which the gate electrode is discharged such that a voltage of the gate electrode of the first transistor becomes proximate to a threshold voltage, thereafter the gate electrode of the first transistor is charged to a voltage in accordance with the voltage signal provided to the first switch and the current signal is outputted in accordance with the charged state from the second main electrode of the first transistor.

Further, in the constitution in which the voltage of the gate electrode of the first transistor is discharged to be proximate to the threshold voltage, there can preferably be adopted a constitution in which the gate electrode is discharged such that a voltage of the gate electrode of the first transistor becomes proximate to a threshold voltage in a time period in which the voltage signal provided to the first switch is at a reference level.

Further, there can preferably be adopted a constitution in which a current signal output circuit comprising at least two of the current signal control circuits according to any one of claims 4 to 8, wherein the gate electrode of the first transistor is charged to a voltage in accordance with the voltage signal in other of the current signal control circuits when the current signal is outputted in one of the current signal control circuits. There can preferably be adopted a constitution in which each of the current signal control circuits includes a switch for controlling whether the current signal outputted from the second main electrode of the first transistor is outputted to outside, when the switch of one of the current signal control circuits is brought into a state of outputting the current signal outputted from the second main electrode of the first transistor to outside, the switch of other of the current signal control circuits is controlled to a state in which the current signal outputted from the second main electrode of the first transistor is not outputted to outside.

Further, the application includes another aspect of the invention of a display apparatus characterized in including the above-described current signal output circuit and a plurality of display elements in which the current signal output circuit supplies the current signal successively to the plurality of display elements.

Particularly, the application includes another aspect of the invention of a display apparatus include the current signal output circuit according to claim 9 and a plurality of display elements in which the current signal output circuit is constituted to successively supply the current signal to the plurality of display elements and is controlled such that a corresponding relationship between at least two of the current signal control circuits constituting the current signal output circuit and respectives of the plurality of display elements is not fixed. That the current signal output circuit is controlled such that the corresponding relationship between at least two of the current signal control circuits constituting the current signal output circuit and respectives of the plurality of display elements is not fixed, signifies that when the current signal is successively supplied to the plurality of display elements by plural times, in a certain series of successive supply, when the output current from one of the current signal control circuits is supplied to a predetermined display element, in a series of successive supply different from the above-described series thereof such as a series thereof successive to the above-described series thereof, the output current from other of the current signal control circuits is supplied to the predetermined display element. When a screen is constituted by a plurality of display elements, a constitution of changing the current signal control circuits in correspondence with the respective display elements at each updating of the screen (including a case in which content of the display screen is not changed) at, for example, each frame is particularly preferable.

Further, as display apparatus there can preferably be adopted a constitution using the current signal output circuit for inputting a column direction signal and having a row direction control circuit for controlling a row direction signal as the display apparatus. Specifically, there can preferably be adopted a constitution further comprising a plurality of sets each comprising the current signal output circuit according to claim 10 or claim 11 and the plurality of display elements to which the current signal output circuit successively supplies the current signal, wherein a matrix of the display elements is constituted by the display elements belonging to the respective sets, the current signal output circuit controls the matrix in a column direction thereof and includes a row control circuit for controlling the matrix in a row direction thereof.

Further, with regard to the constitution having the fourth switch and the sixth switch, there can be adopted a display apparatus comprising the current signal output circuit, and arranging a plurality of display elements for receiving supply of a signal from an output signal of the current signal at a two dimensional region, including a function of selectively operating the fourth and the sixth switches and the fourth and the sixth switches are changed by an odd number row or an even number row by a frame of a displayed image signal. When there are not other switches in correspondence with the fourth and the sixth switches, the fourth and the sixth switches may complimentarily be operated.

Further, as a constitution in which the corresponding relationship between the current signal control circuit and the display element is not fixed, there can preferably be adopted a constitution in which the current signal control circuit switches to output signals in correspondence with respective colors.

Further, as display elements in the above-described constitution, various constitutions of display elements such as combining an electron discharge element and a luminescent member which becomes luminescent by electrons discharged by the electron discharge element, particularly, the display element using the electroluminescence element is preferable. Further specifically, the display element having an electroluminescence element and a pixel circuit for driving the electroluminescence element can preferably be used.

Further, there can particularly preferably be adopted a constitution in which the display element includes the pixel circuit, the pixel circuit holds a voltage value in correspondence with a signal from the current signal output circuit and outputs a current value in accordance with the held voltage value.

BRIEF DESCRIPTION OF THE DRAWINGS

FIG. 10A is a circuit diagram. FIG. 10B is a view for explaining a voltage to current conversion characteristic of the circuit of FIG. 10A;

FIG. 8A is a circuit diagram. FIG. 8B is a view for explaining a voltage to current conversion characteristic of the circuit of FIG. 8A;

DETAILED DESCRIPTION OF THE PREFERRED EMBODIMENTS

Figure 13:
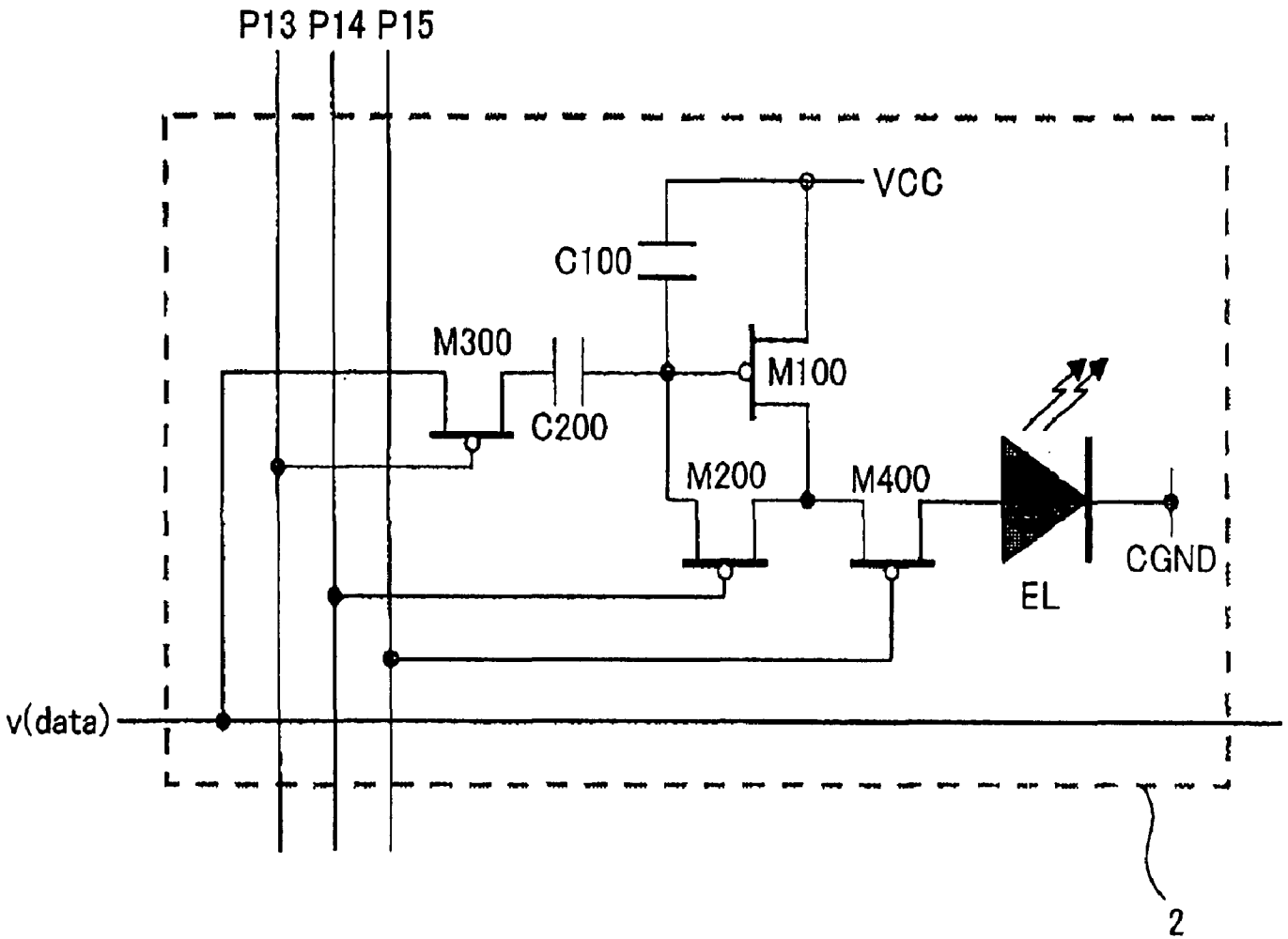
FIG. 13 is a pixel circuit by the voltage setting system.
Figure 14:
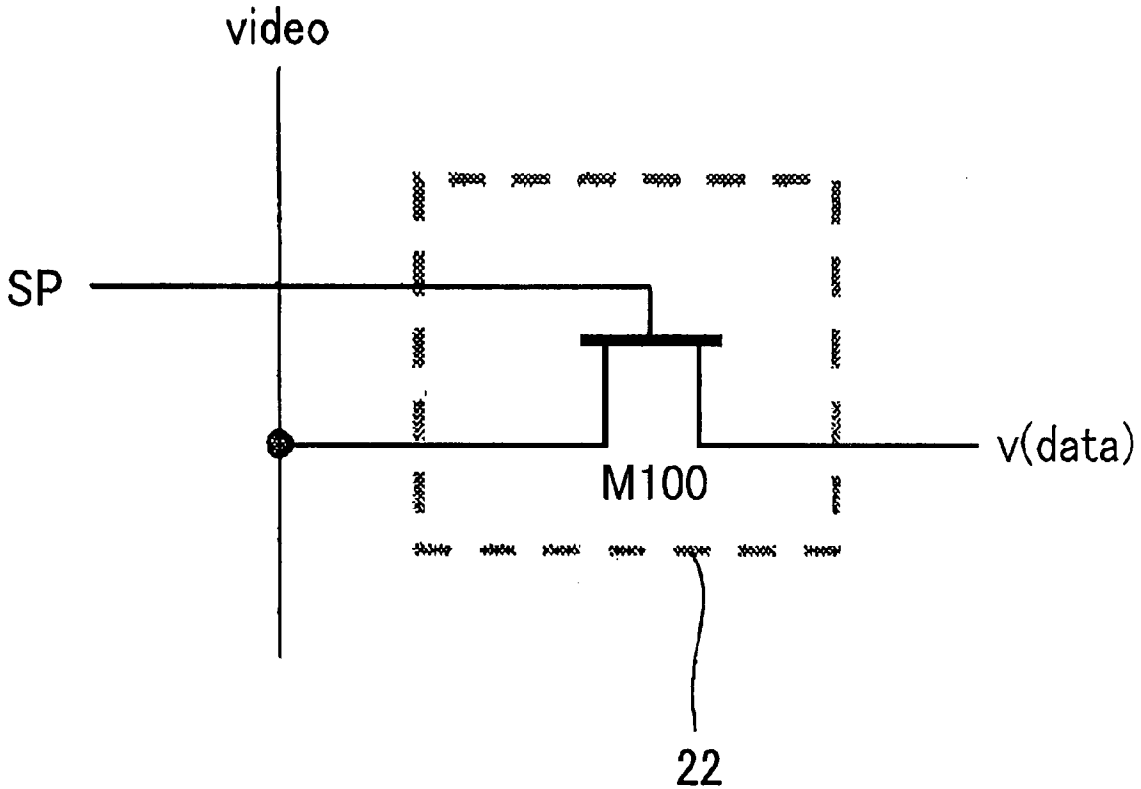
FIG. 14 is a column control circuit by the voltage setting system.
Figures 15A, 15B, 15C, 15D, 15E:
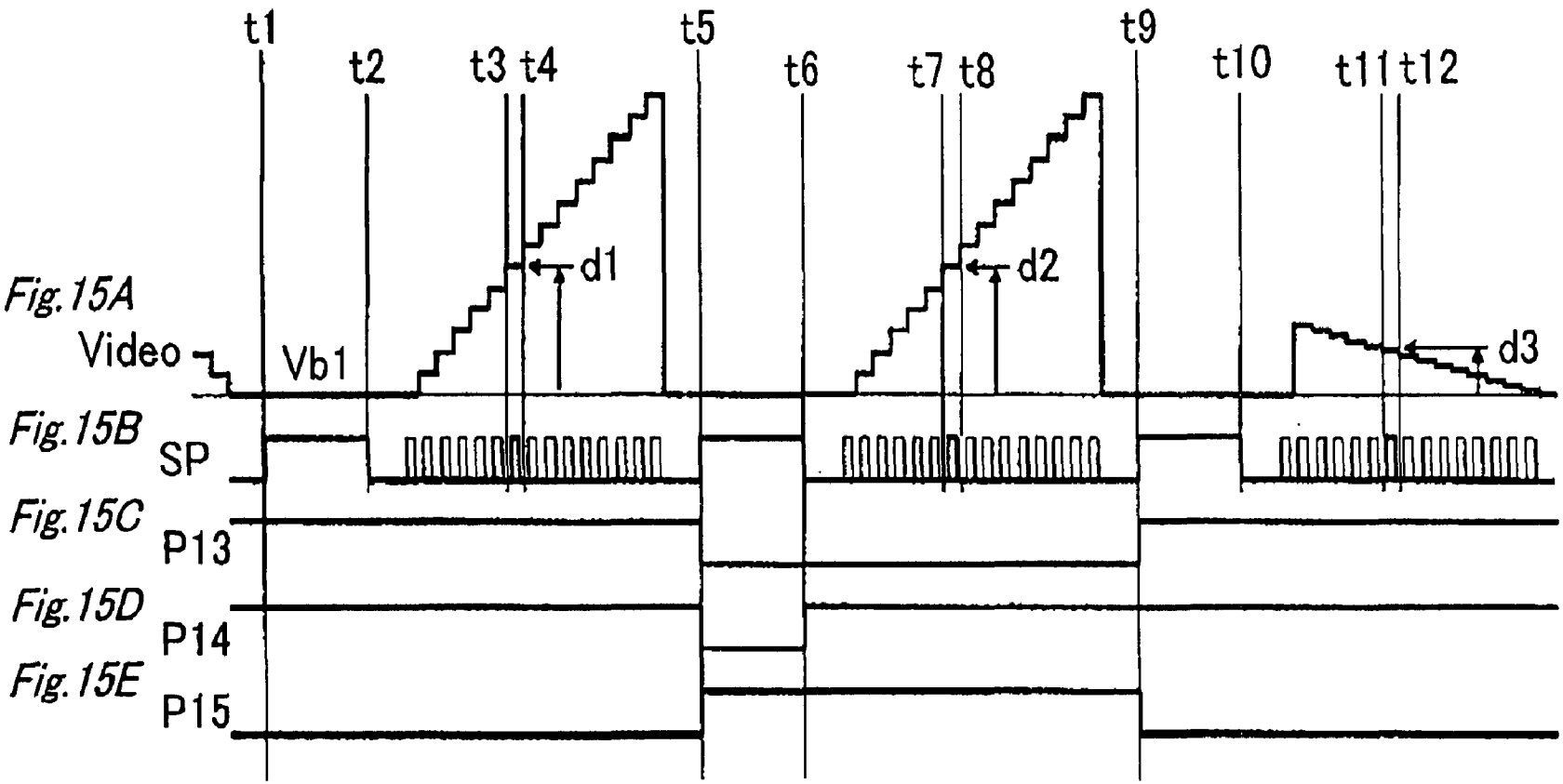
FIGS. 15A, 15B, 15C, 15D and 15E are time charts for explaining operation of the EL panel of FIG. 12.

First, when the pixel circuit of the voltage setting system as shown in FIG. 13 is used, although a dispersion among transistors having the threshold voltage of Vth can be reset, the pixel circuit cannot deal with a dispersion in a drive coefficient β caused mainly by a dispersion in a mobility μ of the channel. Although it is preferable to enlarge a gate region area of the current-driven transistor M100 in order to restrain the dispersion in the mobility μ of channel, in the case of a small-sized and highly fine panel aiming at 200 ppi considerably restricting the pixel circuit area, the dispersion in the drive coefficient β cannot significantly be improved by the gate region area of the drive transistor M100.

Therefore, particularly in the case of assuming a small-sized display panel, there poses a problem that an image having a fixed noise in which brightnesses of individual pixels are randomly varied is brought about and a display panel having high image quality cannot be realized.

Figure 4:
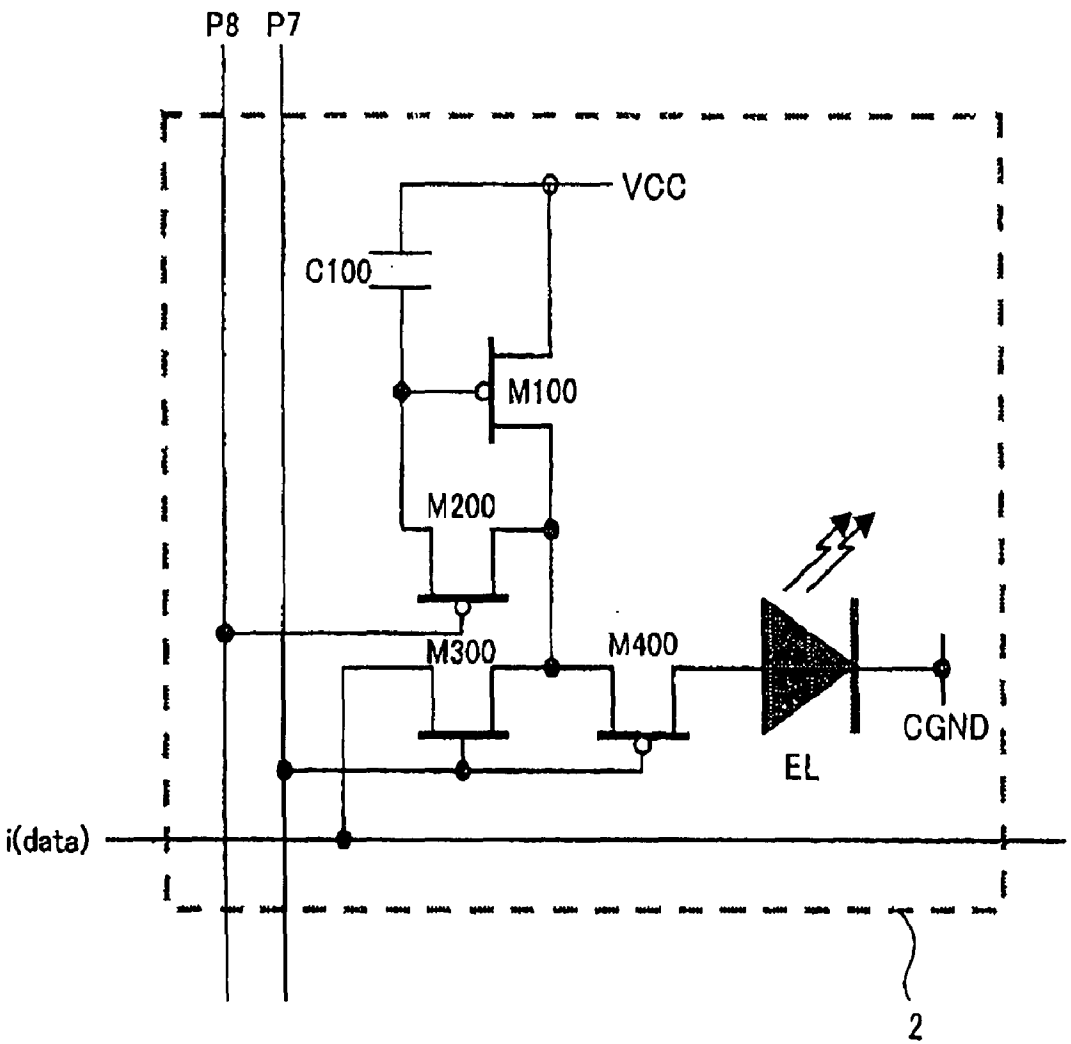
FIG. 4 is a pixel circuit of the current setting system.

Further, when the pixel circuit of the current setting system as shown in FIG. 4 is used, although dispersions in the threshold voltage Vth and the drive coefficient β can be reset even in a small-sized and highly fine display panel at the individual pixel circuit 2, in the case of the current setting system, there is needed the current control circuit for outputting the current signal i (data) by carrying out voltage to current conversion from the point successive signal to the line successive signal as the column control signal 14.

Figure 10A:
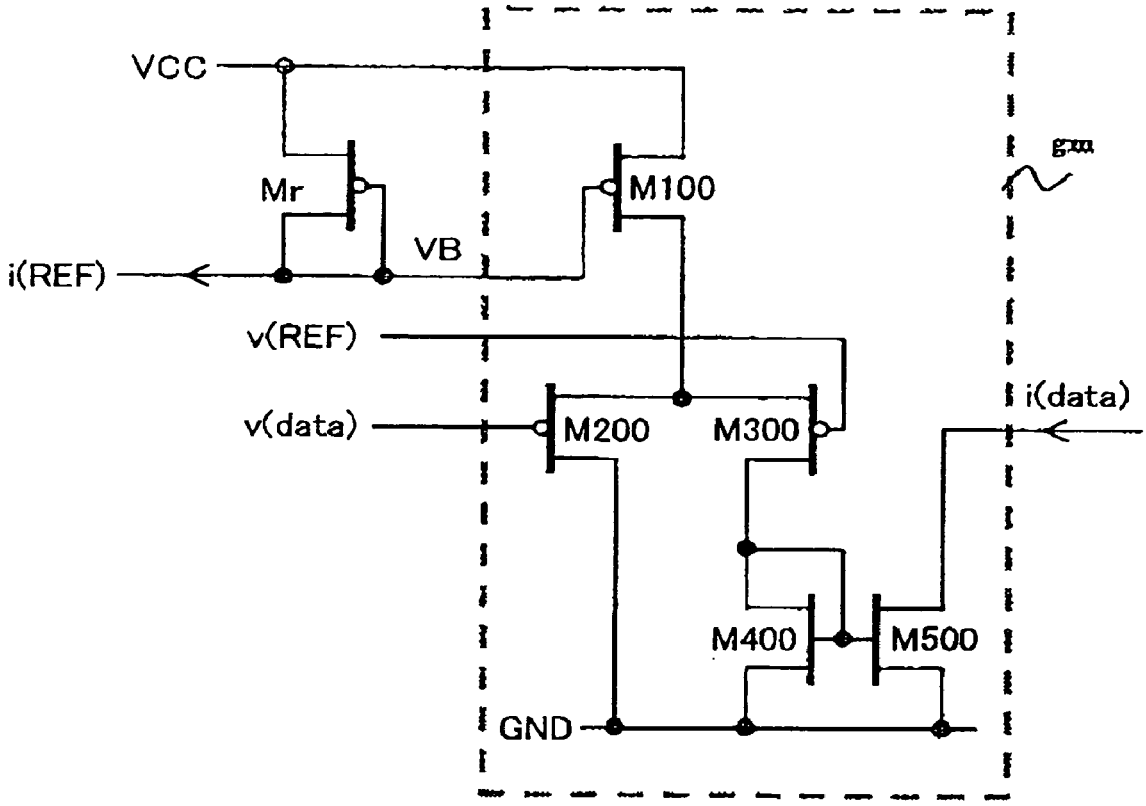
FIGS. 10A and 10B are views for explaining a voltage to current conversion circuit used in the column control circuit of the embodiment of FIG. 8.
Figure 10B:
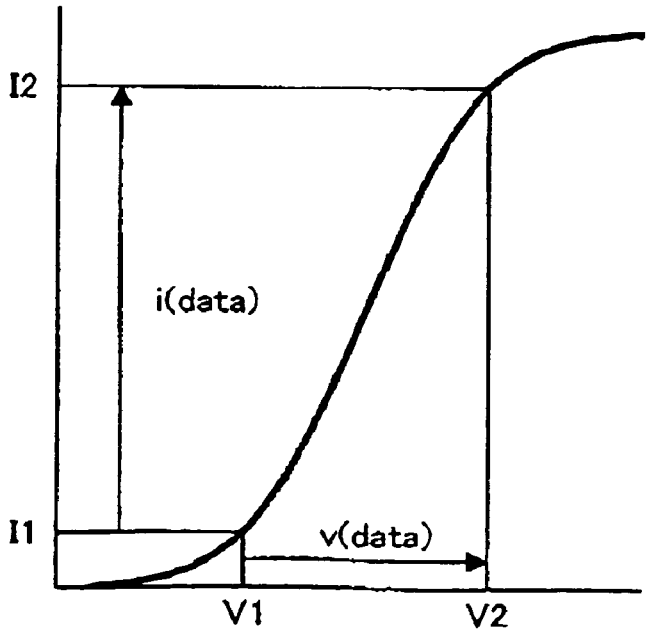
Figure 11A:
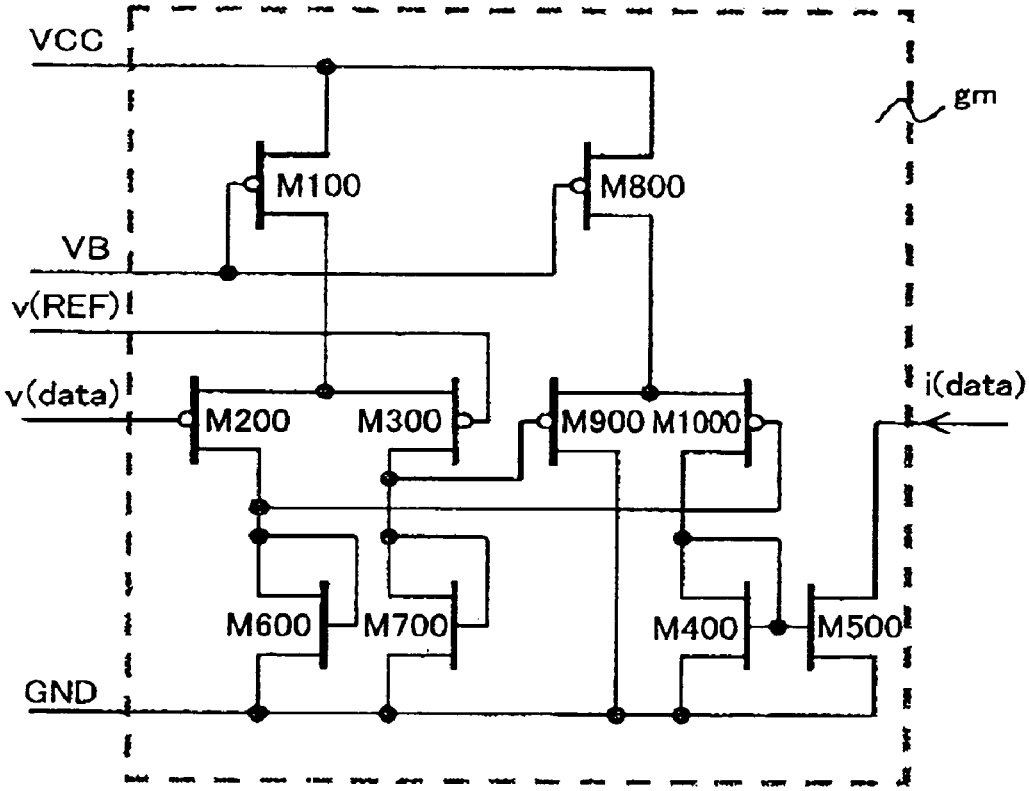
FIGS. 11A and 11B are views for explaining other voltage to current conversion circuit of the embodiment of FIG. 8.
Figure 11B:
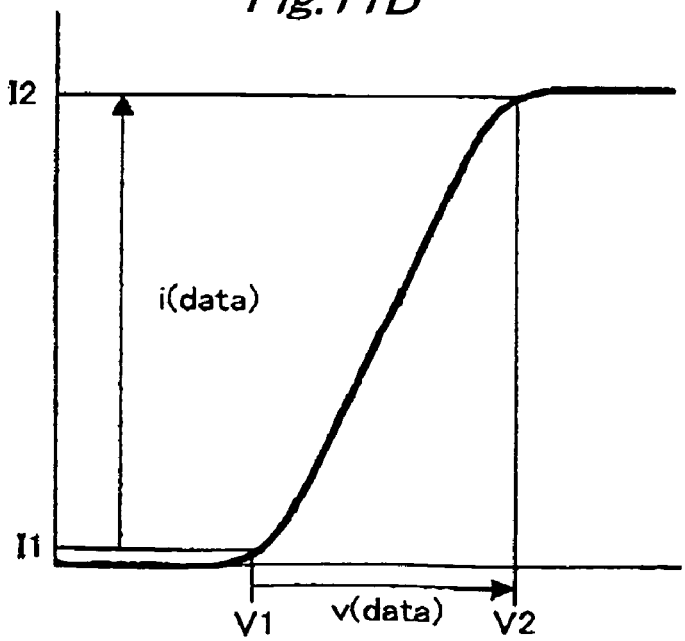
Figure 12:
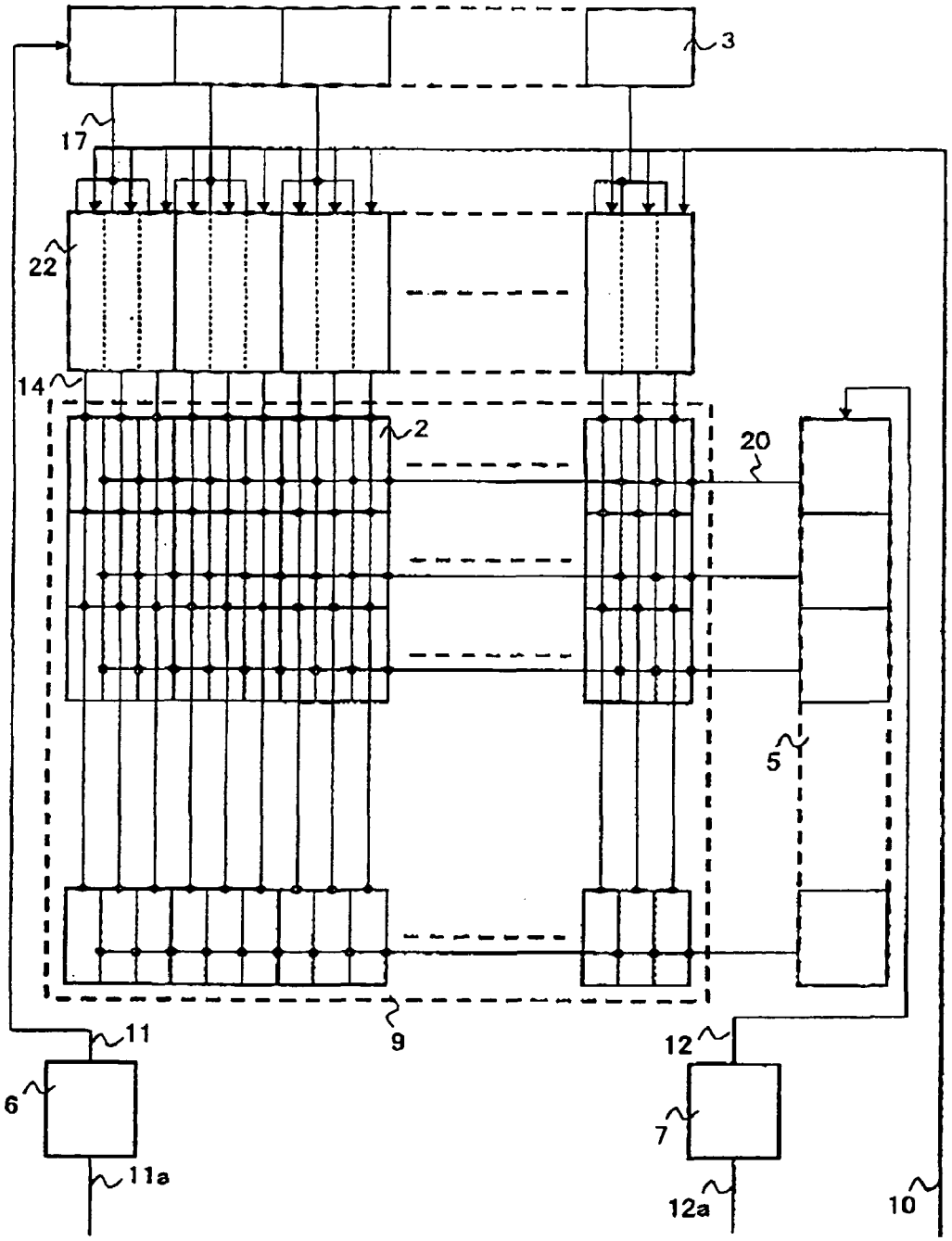
FIG. 12 is a circuit diagram of a total of an EL panel by a voltage setting system.

However, according to the voltage to current conversion circuit gm including the source-coupled circuits and the current mirror circuit as shown in FIG. 10A and FIG. 11A, the voltage to current conversion characteristics of the respective pixel columns cannot be made uniform by the dispersions in the threshold voltage Vth and the drive coefficient β of TFT, a display panel having a fixed pattern of vertical stripes as an image is brought about and high image quality formation is difficult.

Further, when the current signal honest to the input image signal is going to be outputted to the pixel circuit as described above, the constitution of the column control circuit becomes complicated, which cannot be regarded as pertinent for small-sized formation of the display panel.

Figure 1:
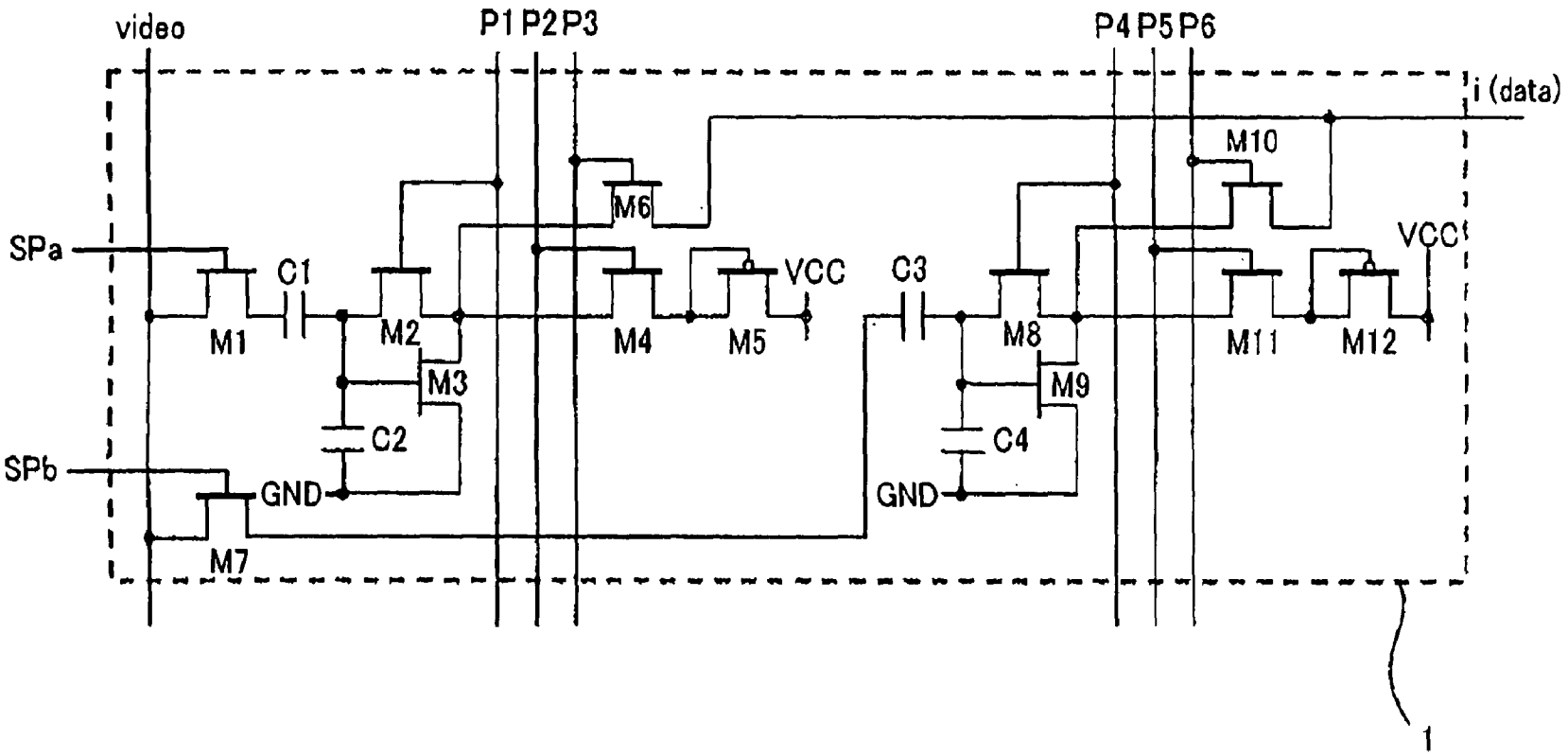
FIG. 1 shows an embodiment of a column control circuit included in an electroluminescence element drive control circuit.
Figure 3:
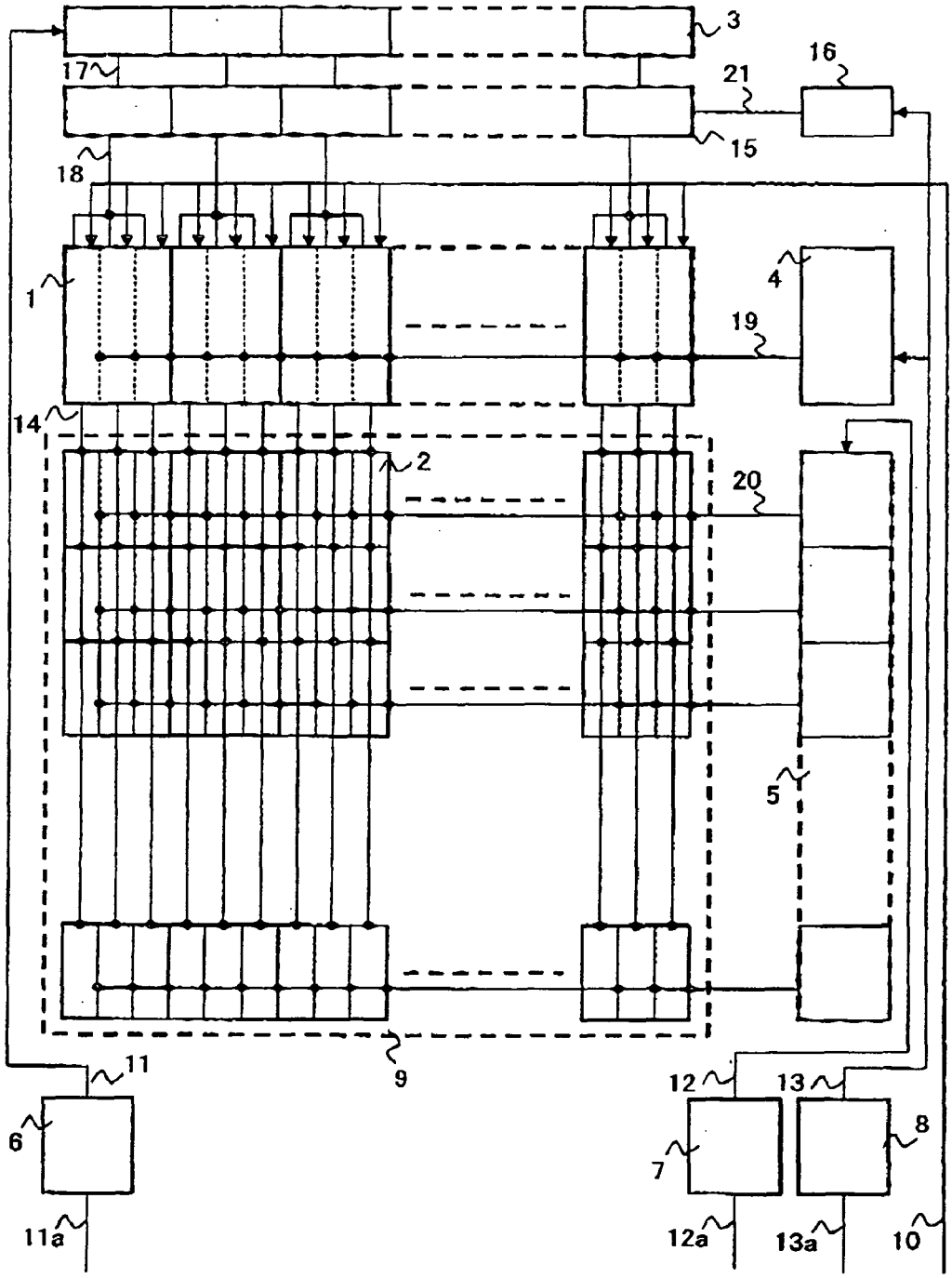
FIG. 3 is a circuit diagram of a total of an EL panel by a current setting system.

FIG. 1 shows an embodiment of a current signal control circuit (hereinafter, described mainly as column control circuit) included in an electroluminescence element drive control circuit used in an EL panel of a current setting system as shown in FIG. 3. Although a detailed explanation will be given of the invention in reference to a specific embodiment shown in FIG. 1 as follows, the invention is not limited to the embodiment.

According to a preferable embodiment shown in FIG. 1, a column control circuit 1 includes at least a first through an eighth switch (M1, M7, M2, M6, M8, M10, M4, M11), a first and a second capacitor element (C1, C3) and a first through a fourth transistor (M3, M9, M5, M12). A first terminal of the first switch M1 is connected to an information voltage signal line (image signal video) for providing an information voltage signal, a second terminal of the first switch M1 is connected to a first terminal of the capacitor element C1, a second terminal of the first capacitor element C1 is connected to a gate electrode of the first transistor M3, the first terminal and a second terminal of the third switch M2 are respectively connected to the gate electrode and a second main electrode of the first transistor M3, a first main electrode of the first transistor M3 is connected to a first power source (GND), the second main electrode of the first transistor M3 is connected to a first terminal of the fourth switch M6 and a first terminal of the seventh switch M4, a second terminal of the seventh switch M4 is connected to a first main electrode of the third transistor M5, a gate electrode and a first main electrode or a second main electrode of the third transistor M5 are shortcircuited and the second main electrode is connected to a second power source (VCC), a first terminal of the second switch M7 is connected to the information voltage signal line (image signal video) providing the information voltage signal, a second terminal of the second switch M7 is connected to a first terminal of the second capacitor element C3, a second terminal of the second capacitor element C3 is connected to a gate electrode of the transistor M9, a first terminal and a second terminal of the fifth switch M8 are respectively connected to a gate electrode and a second main electrode of the transistor M9, a first main electrode of the second transistor M9 is connected to the first power source GND, the second main electrode of the second transistor M9 is connected to a first terminal of the sixth switch M10 and a first terminal of the eighth switch M11, a second terminal of the eighth switch M11 is connected to a first main electrode of the fourth transistor M12, a gate electrode and the first main electrode or a second electrode of the transistor M12 are shortcircuited and the second main electrode is connected to a second power source VCC, the second terminals of the fourth and the sixth switches M6 and M10 are connected to each other to constitute a current signal output terminal for outputting the current signal to outside, and control terminals of the first through the eighth switches (M1, M7, M2, M6, MB, M10, M4, M11) are respectively connected to a first through an eighth control signal line (SPa, SPb, P1, P3, P4, P6, P2, P5). Further, according to the embodiment of FIG. 1, the column control circuit 1 also includes a third capacitor element (C2) and a fourth capacitor element (C4), a first terminal of the third capacitor element C2 is connected to the first power source, a second terminal thereof is connected to the gate electrode of the first transistor M3, a first terminal of the fourth capacitor element C4 is connected to the first power source and a second terminal thereof is connected to the gate of the second transistor M9, however, the capacitor elements C2 and C4 may be realized by only gate input capacitances (channel capacitance) of M3 and M9 and in this case, the capacitors C2 and C4 are not needed.

Next, with regard to a case of specifying channel characteristics of the transistors such that M1 is of n-channel and M5 is of p-channel as shown in FIG. 1, the constitution of the invention will be shown further specifically and the operation will be explained, however, this is only an example, when a relationship of potential between the first power source GND and the second power source VCC or the channel characteristics of the respective transistors are reverted, the constitution may pertinently be changed in accordance therewith.

The column control circuit 1 is inputted with the image signal video, the sampling signals SPa and SPb, and P1 through P6 which are the control signals 19.

The image signal video is connected to M1/S and M7/S and the sampling Signals SPa and SPb are respectively connected to M1/G and M7/G. M1/D is connected to the capacitor C1 and other end of the capacitor C1 is connected to the capacitor C2 one end of which is grounded and M3/G the source of which is grounded. M3/D and M3/G are connected to M2/D and M2/S, and M2/G is connected with P1. M3/D is connected to M4/S, M4/D is connected to M5 the source of which is connected to the power source VCC and the gate and the drain of which are shortcircuited and M4/G is connected with P2. Further, M3/D is connected to M6/S, M6/D is connected to the terminal for outputting the current signal i (data) and M6/G is connected with P3. Meanwhile, M7/D is connected to the capacitor C3 and other end of the capacitor C3 is connected to the capacitor C4 one end of which is grounded and M9/G the source of which is grounded. M9/D and M9/G are connected to M8/D and M8/S, and M8/G is connected with P4. M9/D is connected with M11/S, M11/D is connected to M12 the source of which is connected to the power source VCC and the gate and the drain of which are shortcircuited and M11/G is connected with P5. Further, M9/D is connected to M1/S, M10/D is connected to the terminal for outputting the current signal i (data) and M10/G is connected with P6. Further, gate sizes (W, L) and capacitance values of the respective transistors are constituted as follows.

$$M1=M7,\ M3=M9,\ M2=M8,\ M5=M12,\ C1=C3,\ C2=C4 \quad (3)$$

(Explanation of Operation of Column Control Circuit)

FIGS. 2A, 2B, 2C, 2D, 2E, 2F, 2G, 2H, 2I, 2J, 2K and 2L are time charts for explaining operation of FIG. 1. FIGS. 2A, 2B, 2C, 2D, 2F, 2F, 2G, 2H, 21, 2J, 2K and 2L show operation of three horizontal scanning periods of the image signal, that is, of an amount of three rows in view from the EL panel.

Immediately Before Time t1

SPa and SPb are respectively at L, L level and P1 through P6 are respectively at L, L, H, L, H, L level. Therefore, the respective transistors for carrying out switching operation become as follows.

M1=Off, M2=OFF, M4=OFF, M6=ON, M7=OFF, M8=OFF, M11=ON, M10=OFF

At this occasion, M3 and M9 are driven by current by hold voltages Va1 and Vb1 respectively charged to the capacitors accompanied by the gate electrodes. That is, M3/D current Ia1 is outputted to the current signal i (data) to constitute the column control signal 14. M9/D current is supplied to M12 to determine M9/D voltage.

Time t1 through t7

At time t1, the input image signal video becomes a blanking level Vb1 and SPa, P2, P3, P5, P6 are respectively changed to H, H, L, L, H level.

Therefore, the respective transistors for carrying out switching operation become as follows.

M1=ON, M2=OFF, M4=ON, M6=OFF, M7=OFF, M8=OFF, M11=OFF, M10=ON

At this occasion, M9/D current Ib1 driven by Vb1 of M9/G voltage is outputted to the current signal i (data) in place of M3/D current Ib2. The current signal i (data) is connected to elements in correspondence with a large column pixel number bypassing a column length of the EL panel and therefore, large parasitic capacitance must be driven and therefore, as shown in the FIGURES time is required in effective current supply transition Ta1→Ib1 for the pixel circuits. Before time t2 is reached, P1 becomes H level to constitute M2=ON and M3/G is charged by M5 in a short period of time from the time point to time t2.

At time t2, the operation of charging M3/G by M5 is stopped and M3/G carries out self discharge operation to be proximate to the threshold voltage Vth of its own.

At time t3, SPa is changed to L level and constitutes M1=OFF. Before time t4, P1 is changed to L level to constitute M2=OFF and the self discharge operation of M3 is finished at the time point. During a period from this time point to time t4, both of M2 and M4 are made OFF and M3/D is rapidly changed to L level and therefore, more or less voltage drop is generated at M3/G as shown in the figure by drain-gate capacitance or the like.

At time t4 at which P2 is changed to H level, M4=ON is constituted and therefore, voltage of M3/D rises again and therefore, voltage of M3/G rises again as shown in the figure to return to substantially the original state. At the time point, the voltage of M3/G is proximate to the threshold voltage Vth of its own and therefore, M3/D current is almost zero. In an effective period of the image signal video of time t1 through t7, although the horizontal sampling signal group SPa is generated, the horizontal sampling signal group SPb is not generated. At time t5 through t6 , the horizontal sampling signal SPa of the corresponding row is generated and the voltage of M3/G held at the vicinity of the threshold voltage Vth of its own is changed by transition voltage ΔV1 by the image signal level d1 constituting the reference by the blanking level at the time point.

ΔV1 is Generally Shown by Equation (4).

$$\Delta V1=d1\times C1\div(C1+C2+C(M3)) \quad (4)$$

Notation C (M3) designates gate input capacitance of M3. At this occasion, M3/D current is shown by Equation (2). When corresponding SPa is changed to L level, M1=OFF is constituted and changed to Va2 more or less dropped by the parasitic capacitance operation of M1 and the voltage of M3/G is brought into the holding state again.

Time t7 through t13

At time t7 , the input image signal video becomes the blanking level Vb1 and SPb, P2, P3, P5, P6 are respectively changed to H, L, H, H, L level.

Therefore, the respective transistors for carrying out switching operation become as follows.

M1=OFF, M2=OFF, M4=OFF, M6=ON, M7=ON, MB=OFF, M11=ON, M10=OFF

At this occasion, M3/D current Ia2 driven by Va2 of the voltage of M3/G is outputted to the current signal i (data) in place of M9/D current Ib1. The current signal i (data) is connected to the elements in correspondence with the large column pixel number by passing the column length of the EL panel and therefore, must drive large parasitic capacitance and therefore, time is required in effective current supply transition Ib1→Ia2 for the pixel circuit as shown in the figure. Before time t8 is reached, P4 becomes H level to constitute M8=ON and in a short period of time from the time point to time T8, M9/G is charged by M12.

At time t8, the operation of charging M9/G by M12 is stopped and M9/G carries out self discharge operation to be proximate to the threshold voltage Vth of its own.

At time t9, SPb is changed to L level to constitute M7=OFF. Before time t10 is reached, P4 is changed to L level to constitute M8=OFF and at the time point, the self discharge operation of M9 is finished. During a period from the time point to time t10, both of M8 and M11 are made OFF and M9/D is rapidly changed to L level and therefore, the voltage of M9/G is more or less dropped as shown in the figure by the drain-gate capacitance or the like.

At time t10 at which P5 is changed to H level, M11=ON is constituted and therefore, the voltage of M9/D rises again and therefore, the voltage of M9/G rises again to return to substantially original state as shown in the figure. At the time point, the voltage of M9/G is at the vicinity of the threshold voltage Vth of its own and therefore, M9/D current is almost zero. In an effective period of the image signal video at time t7 through t13, although the horizontal sampling signal group SPb is generated, the horizontal sampling signal group SPa is not generated.

At time t11 through t12 , the horizontal sampling signal SPb of the corresponding column is generated and the voltage of M9/G held at the vicinity of the threshold voltage Vth of its own is changed by transition voltage ΔV2 by the image signal level d2 constituting the reference by the blanking level at the time point. ΔV2 is generally shown by Equation (5)

$$\Delta V2=d2\times C3\div(C3+C4+C(M9)) \quad (5)$$

Notation C(M9) designates a gate input capacitance of M9. At this occasion, M9/D current is shown by Equation (2). When corresponding SPb is changed to L level, M7=OFF is constituted and the voltage of M9/G is changed to Vb2 which is more or less dropped by the parasitic capacitance operation of M7 and the voltage of M9/G is brought into the holding state again.

Time t13 through 1 Horizontal Scanning Period

At time 13, the input image signal video becomes the blanking level Vb1, and SPa, P2, P3, P5, P6 are respectively changed to H, H, L, L, H level.

Therefore, the respective transistors for carrying out switching operation become as follows.

ML=ON, M2=OFF, M4=ON, M6=OFF,

M7=OFF, M8=OFF, M11=OFF, M10=ON

At this occasion, M9/D current Ib2 driven by Vb2 of the voltage of M9/G is outputted to the current signal i (data) in place of M3/D current Ia2. The current signal i (data) is connected to the elements in correspondence with the large number of column pixel number by passing the column length of the EL panel and therefore must drive the large parasitic capacitance and therefore, when Ia2 and Ib2 are different from each other, similar to the change of Ib1→Ia2, time is required in a change of effective current supply transition Ia2→Ib2 for the pixel circuit. Before time t14 is reached, P1 becomes H level to constitute M2=ON and M3/G is charged by M5 in a short period of time from this time point to time t14.

At time t14, operation of charging M3/G by M5 is stopped and M3/G carries out self discharge operation to be proximate to the threshold voltage Vth of its own.

At time t15, SPa is changed to L level to constitute M1=OFF. Before time t16 is reached, P1 is changed to L level to constitute M2=OFF and the self discharge operation of M3 is finished at the time point. During a period from this time point to time t16, both of M2 and M4 become OFF and M3/D is rapidly changed to L level and therefore, the voltage of M3/G is more or less dropped as shown in the figure by the drain-gate capacitance or the like.

At time t16 at which P2 is changed to H level, M4=ON is constituted and therefore, the voltage of M3/D rises again and therefore, the voltage of M3/G rises again to return to substantially the original state as shown in the figure. At the time point, the voltage of M3/G is at the vicinity of the threshold voltage Vth of its own and therefore, M3/D current is almost zero.

During an effective period of the image signal video at time t16 through t17, although the horizontal sampling signal group SPa is generated, the horizontal sampling signal group SPb is not generated.

At time t17 through t18, the horizontal sampling signal SPa of the corresponding row is generated and the voltage of M3/G held at the vicinity of the threshold voltage Vth of its own is changed by transition voltage ΔV3 by an image signal level d3 constituting the reference by the blanking level at the time point.

ΔV3 is Generally Shown by Equation (6)

$$\Delta V3=d3\times C1\div(C1+C2+C(M3)) \quad (6)$$

Notation C(M3) designates the gate input capacitance of M3. At this occasion, M3/D current is shown by Equation (2). When corresponding SPa is changed to L level, M1=OFF is constituted and the voltage of M3/G is changed to the voltage Va2 which is more or less dropped by the parasitic capacitance operation of M1 and the voltage of M3/G is brought into the holding state again.

Figure 6:
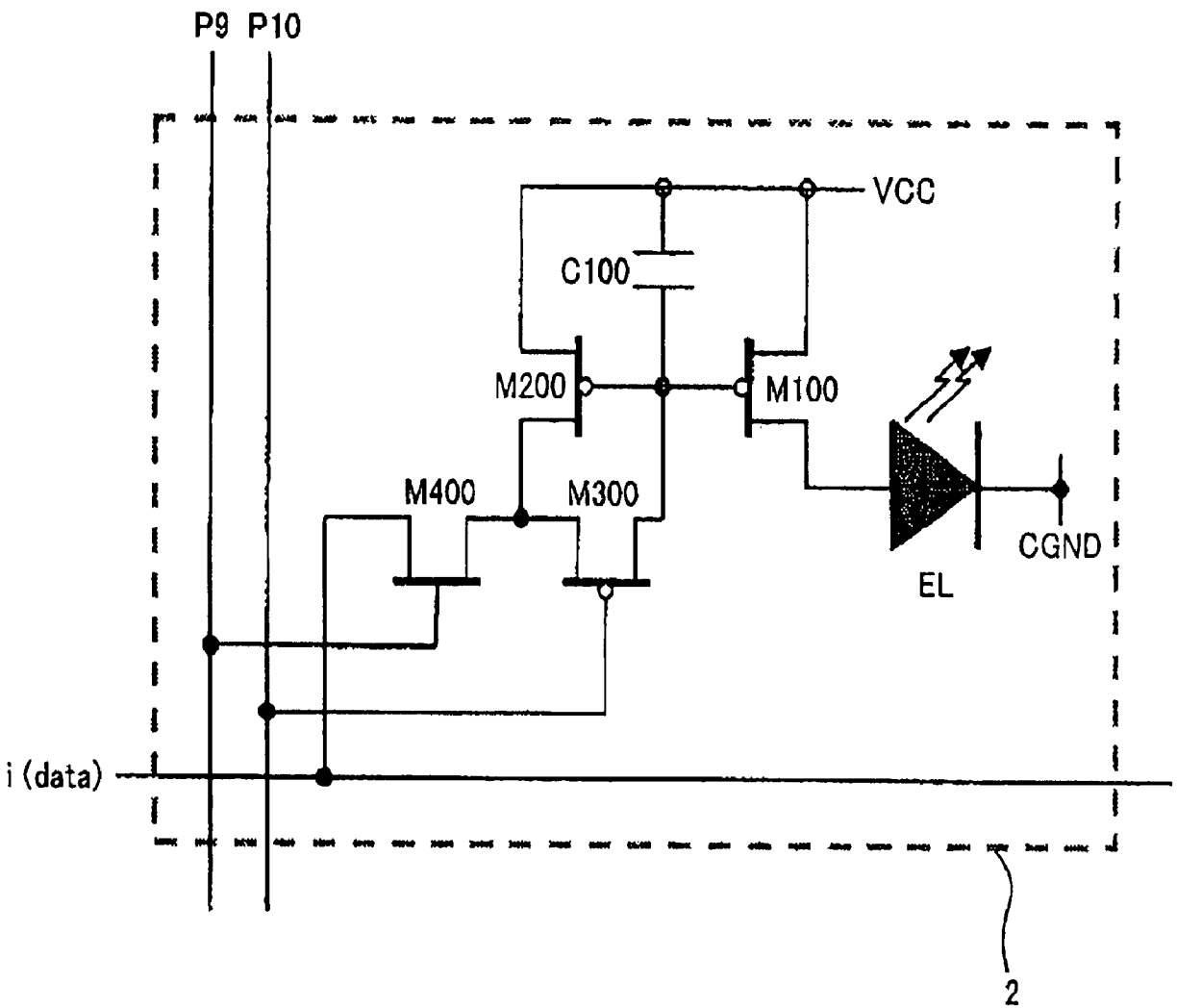
FIG. 6 shows a pixel circuit of a current setting system.
Figures 7A, 7B, 7C:
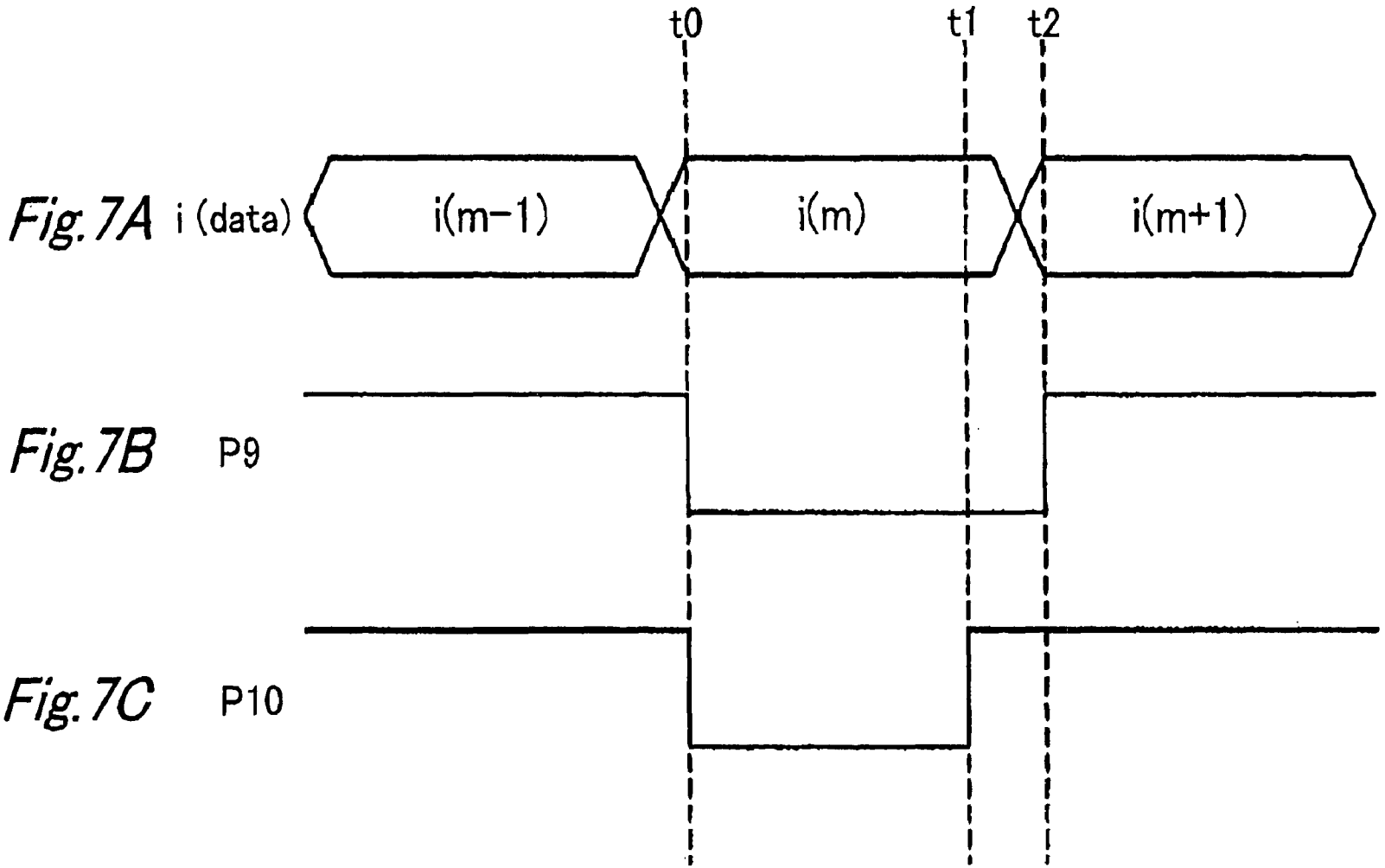
FIGS. 7A, 7B and 7C are time charts for explaining operation of the pixel circuit of FIG. 6.

The EL panel of the invention is realized in an EL panel of a current setting system of an active matrix type as shown in FIG. 3 by using the current signal control circuit of the invention as the column control circuit 1 and the EL panel can be operated similar to that of the background art except that the column control circuit 1 is controlled as described above. Therefore, the pixel circuit 2 having a mode as shown in FIG. 4 or FIG. 6 can naturally be used.

Further, the invention includes an electroluminescence panel in which a plurality of pixel circuits arranged in pair with electroluminescence elements for supplying injected current to each of the electroluminescence elements in accordance with an inputted current signal are arranged at a two-dimensional region, wherein a plurality of current signal control circuits for supplying the current signal to the pixel circuits in accordance with information voltage signals inputted from outside, each of the current signal control circuits is provided with a function of inputting a single one of the information voltage signals, holding a first voltage value in correspondence with the information voltage signal inputted during a time period of writing to the corresponding control circuit and outputting a current signal in correspondence with the held first voltage value to a selected one of the pixel circuits during an output time period of the control circuit and each of the pixel circuits is provided with a function of holding a second voltage value in correspondence with the current signal inputted during the time period of writing to the corresponding one of the pixel circuits and continuing to supply the injected current in correspondence with the held second voltage value to the electroluminescence element during corresponding luminescence time period.

Such an electroluminescence panel includes the EL panel as shown in FIG. 3 using the current signal control circuit of the invention described above in details and using the pixel circuit of the current setting system as shown in FIG. 4 through FIG. 7 as a specific embodiment thereof. The explanation of the constitution and operation of the current signal control circuit according to the invention in reference to FIG. 1 and FIG. 2 corresponds to the explanation of the constitution and the operation of the pixel circuit of the background art in reference to FIG. 4 through FIG. 7 as follows.

Figure 8:
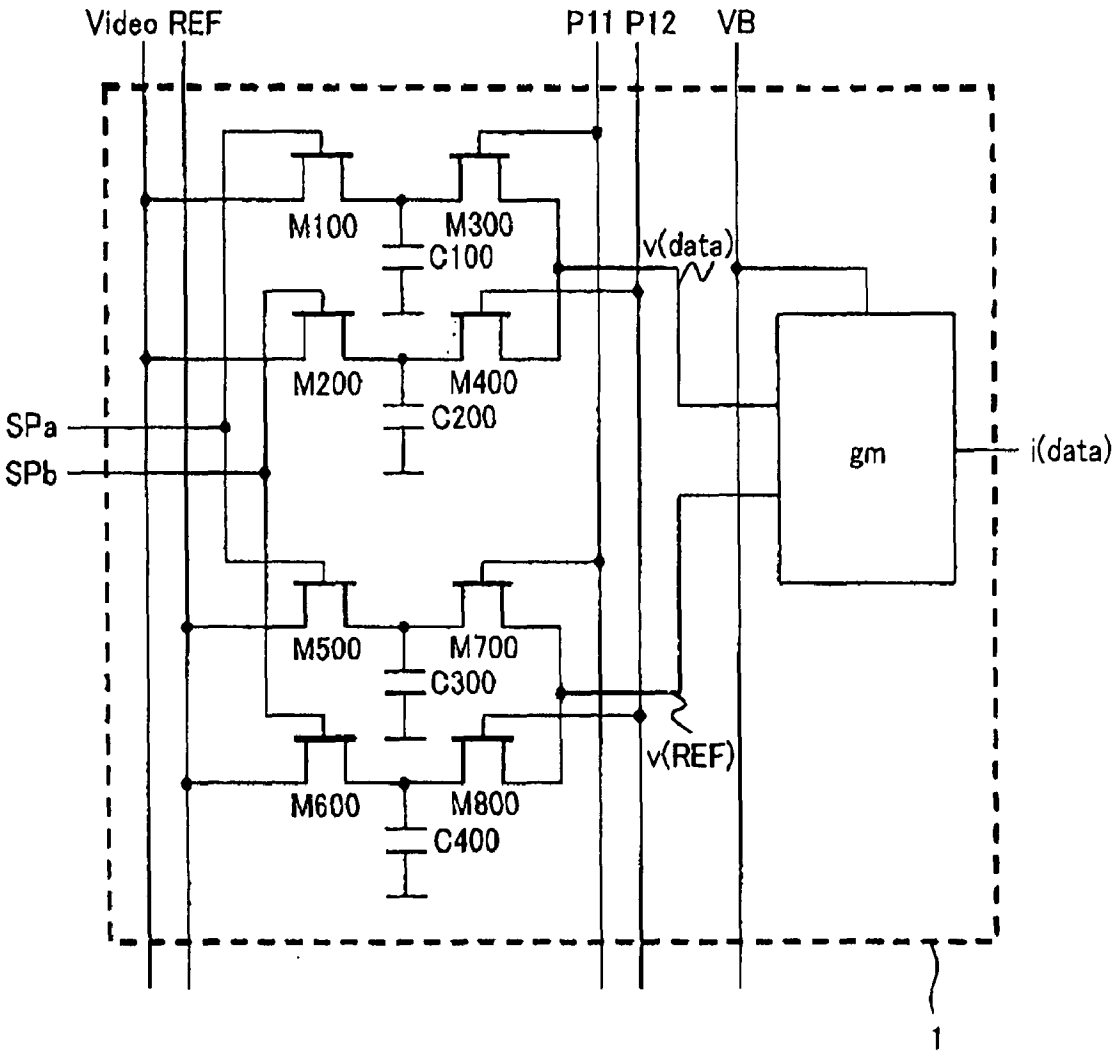
FIG. 8 shows an example of a column control circuit included in an EL element drive control circuit of a current setting system.
Figures 9A, 9B, 9C, 9D, 9E, 9F:
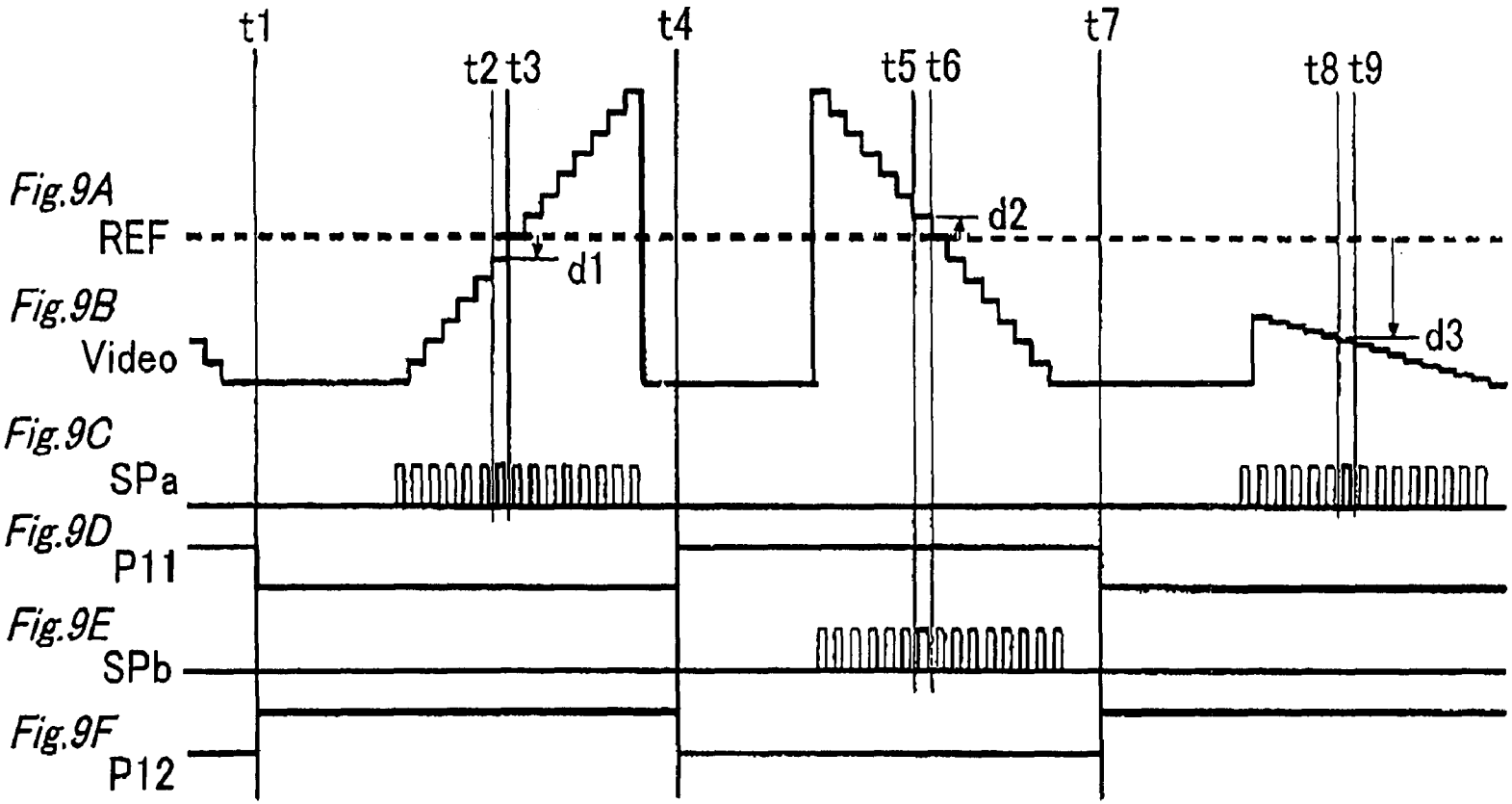
FIGS. 9A, 9B, 9C, 9D, 9E and 9F are time charts for explaining operation of the column control circuit of FIG. 8.

First, the single information voltage signal inputted to the current signal control circuit corresponds to video and different from the background art as shown in FIG. 8, the reference signal REF is not necessary.

Figure 2:
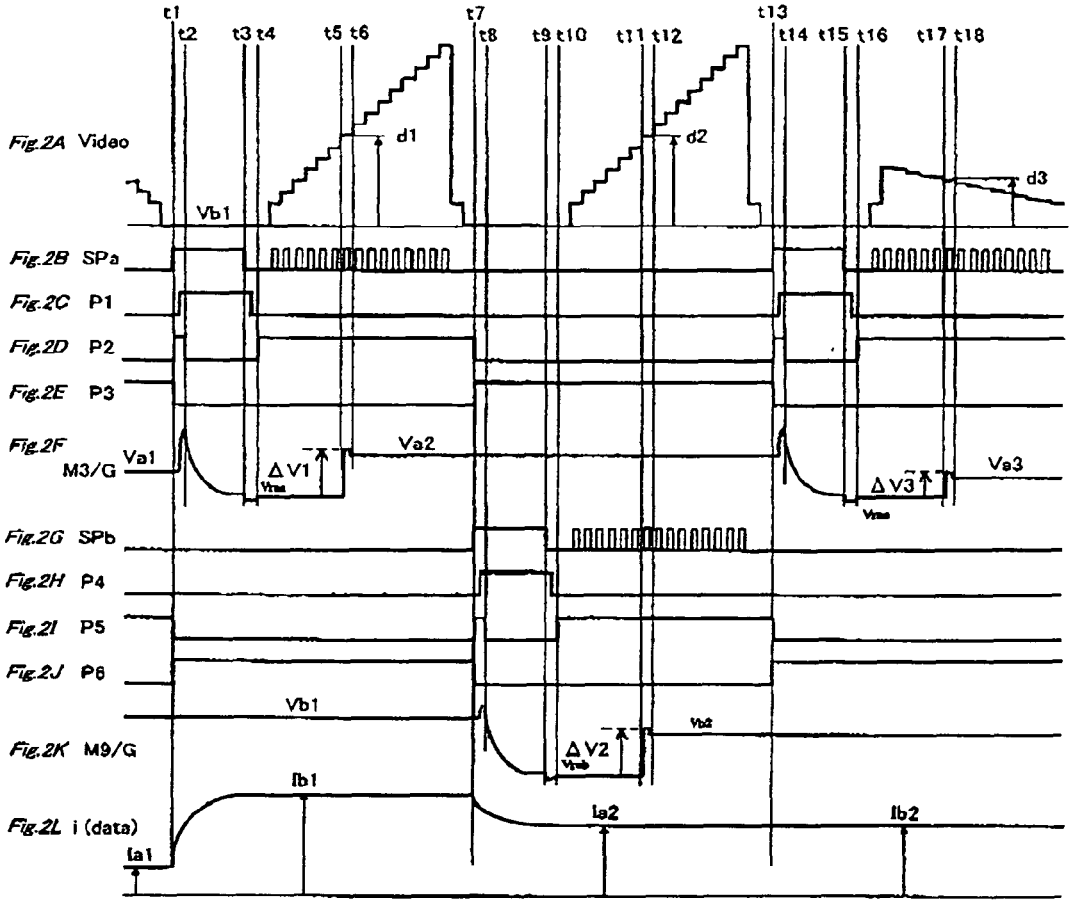
FIGS. 2A, 2B, 2C, 2D, 2E, 2F, 2G, 2H, 2I, 2J, 2K and 2L are time charts for explaining operation of the column control circuit of FIG. 1.

The time period of writing to the corresponding control circuit corresponds to a time period of making the first switch M10N by the sampling signal SPa (for example, a time period in which SPa is at H during t5 through t6 in FIG. 2) in the single current signal control circuit as shown in FIG. 1. The first voltage value in correspondence with the information voltage signal inputted to the corresponding current signal control circuit during the time period is held by, for example, the first capacitor element C1 and the current signal in correspondence with the held first voltage value can be outputted by using the first transistor M3 the gate electrode of which is connected to C1. The current signal is outputted to the selected pixel circuit during the output period of the control circuit, the output period of the control circuit corresponds to a time period in which the fourth switch M6 is made ON by the fourth control signal P3 (for example, a time period at which P3 is at H of t7 through t13 in FIG. 2) in the single current signal control circuit as shown in FIG. 1. Further, selection of the pixel circuit indicates that P7 of the row control signal is at H, M300 is made ON and M100/G is brought into a state of being operated to set during the time period of t0 through t2 in FIG. 5, which is also the time period of writing to the pixel circuit.

Figures 5A, 5B, 5C:
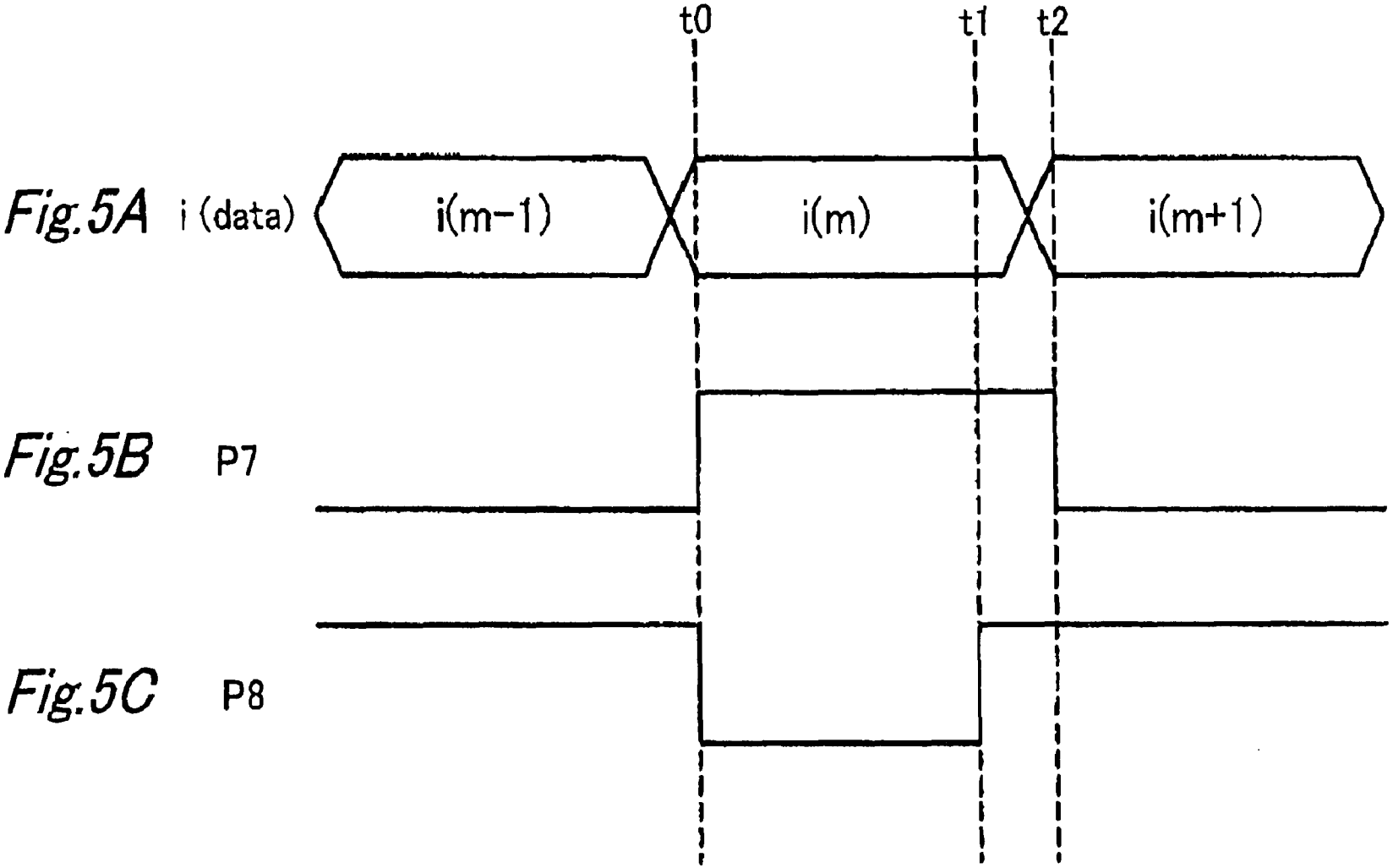
FIGS. 5A, 5B and 5C are time charts for explaining operation of the pixel circuit of FIG. 4.

In each of the pixel circuits, the second voltage value in correspondence with the current signal inputted from the current signal control circuit during the time period of writing to the pixel circuit is held by utilizing the capacitance element C100 as the second voltage holding means in the case of, for example, the pixel circuit of FIG. 4 and the injected current in correspondence with the held second voltage value can continue supplying to the EL element during the corresponding luminescence time period by using the transistor M3 the gate electrode of which is connected to C100 as the injecting means. Here, the corresponding luminescence period is a time period in which, for example, P7 at and after t2 in FIG. 5 is at L, M300 is made OFF, M400 is made ON and the injected current can be supplied to the EL element.

As explained above, according to the invention, the line successive current signal i (data) can be outputted based on the information voltage signal of the input image signal video.

The column control circuit 1 of FIG. 1 is mounted with a voltage setting circuit and therefore, a consideration needs to be given to operation of M3 and M9 which are the current driving transistors. In the EL panel, the column control circuit 1 is provided with an area allowance in comparison with the pixel circuit and therefore, gate areas of M3 and M9 can be enlarged. Although generally, the dispersion $\Delta\beta$ of the drive coefficient of a basic size of TFT is about 20% pp, by enabling to enlarge the gate areas of M3 and M9 as in the invention, when the column control circuit is constituted by a size 16 times as large as that in the case of providing to the pixel electrode, it can be expected that the dispersion AP in the drive coefficient can be made to be about 5% pp of the quarter.

Further, in the operation shown in FIG. 2, when the fourth and the sixth switches (M6, M10) are complimentarily operated by switching the horizontal scanning periods assigned with the control signals of respective pairs of SPa, Pa, P2, P3 and SPb, P4, P5, P6 such that odd number ⇔even number at every image signal frame, the current signal i (data) of each pixel is generated by M3 and M9 and therefore, the dispersion $\Delta\beta$ of the drive coefficient is further reduced to 3.5% pp of a multiplication of $1/\sqrt{2}$ thereof.

Further, it is also possible that color processed by the column control circuit of the corresponding row is not determined but is switched by the input image signal at every image signal frame as in, for example, R→G→B, G→B→R, B→R→G and the current signal i (data) from the current control circuit l of three colors of the same pixel is switched. That is, when at least three colors of the image signal groups are inputted as information voltage signals, by constituting one set by three of the column control circuits and the current signals in correspondence with the image signals of respective colors outputted from the one set of column control circuits are switched to output among the three column control circuits included in the one set to column control circuits by a unit of the image signal frame. In this case, the dispersion $\Delta\beta$ of the drive coefficient can further be reduced to 2.0% pp of a multiplication of $1/\sqrt{3}$ thereof.

Further, according to the invention, by alternately outputting the current signal i (data) by a first block including M1 through M6, C1 and C2 using SPas P1, P2, P3 and a second block including M7 through M12, C3 and C4 using SPb, P4, P5, P6, at a time point of finishing the group of the sample signal SPa or the group of SPb, a desired current output is provided from each of the column control circuits and therefore, such a constitution is preferable. However, when the current is constituted to supply to the pixel circuit from the time point of finishing the group of the sample signal SPa to a successive row control start timing, the column control circuit of FIG. 1 may be constituted by a column control circuit which does not use SPb, P4, P5, P6 and excludes M7 through M12, C3, C4.

Further, in FIG. 1, the basic concept of the invention is not destroyed by eliminating the bias circuit of M3/D and M9/D and the charge circuit of M3/G and M9/G constituted by P2, M4, M5 and P5, M11 and M12.

Further, in FIG. 2, timings of changing P1 and P2 may be constituted by time t1, t3, t13 and t15 to be equal to those of SPa. Further, timings of changing P4 and P5 may be constituted by time t8, t10 to be equal to those of SPb.

Further, although the invention achieves a significant effect when TFT which is normally problematic in the dispersion of the characteristic is used as the transistor, the invention is widely applicable even when the circuit is constituted by an insulating gate type field effect transistor using single crystal silicon.

As explained above, when the EL element drive control circuit applied with the invention is used, the dispersion of the element characteristic of the insulating gate type field effect transistor of TFT or the like can significantly be alleviated without deteriorating a request of highly fine display by a simple circuit constitution and therefore, the EL panel providing display image having uniform characteristic can be realized and significant effect is achieved also in small-sized formation of the highly fine EL panel.

Figure 16:
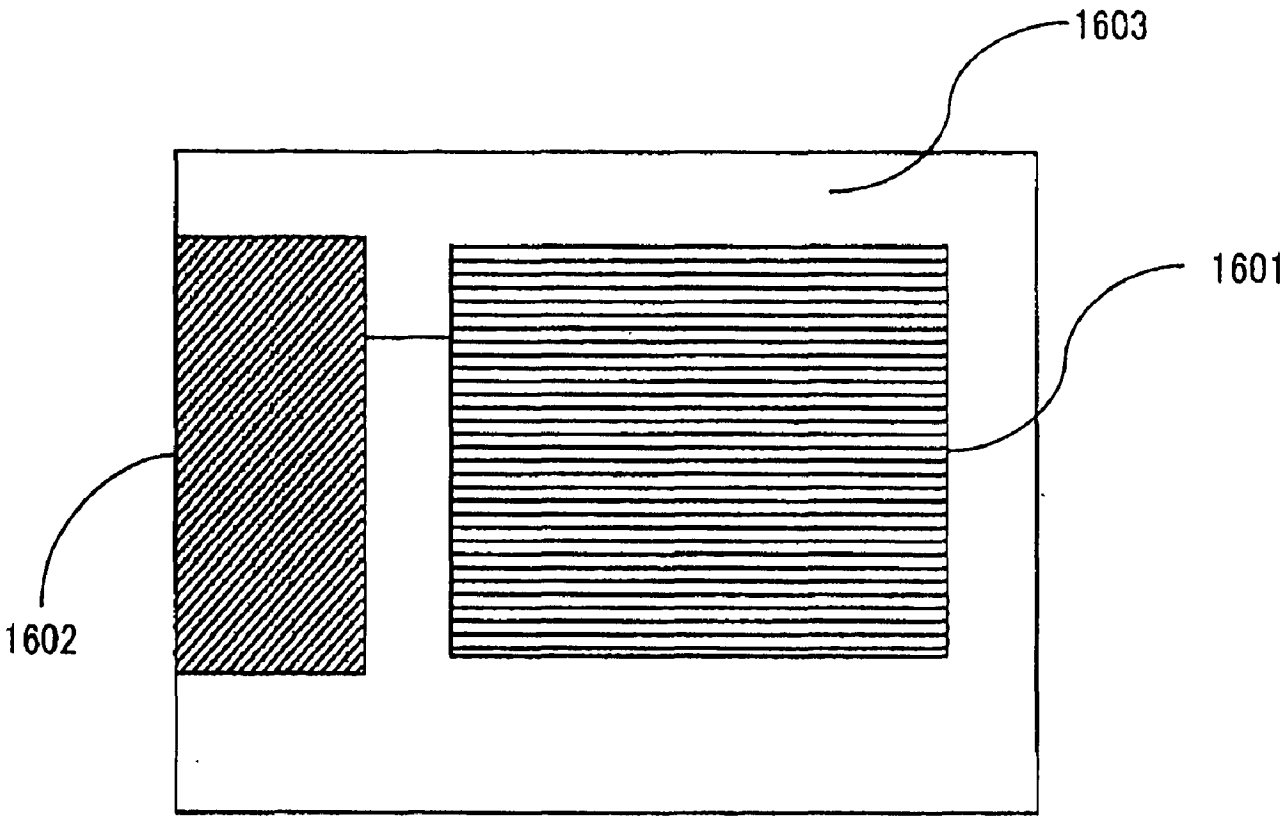
FIG. 16 is a view showing a constitution of an information display apparatus.

FIG. 16 is a view for explaining a constitution of an information display apparatus using the EL panel explained in the above-described embodiment as a display apparatus. The information display apparatus takes a mode of any of a portable telephone, a portable computer, a still camera or a video camera. Or, the apparatus is an apparatus of realizing a plurality of respective functions thereof. An apparatus in correspondence with the EL panel explained in the above-described embodiment is a display apparatus 1601. Notation 1602 designates an information input portion. In the case of a portable telephone, the information input portion is constituted to include an antenna, for example, in the case of PDA or a portable personal computer, the information input portion is constituted to include an interface portion with regard to a network and in the case of a still camera or a movie camera, the information input portion is constituted to include a sensor portion by CCD, CMOS and the like. Notation 1603 designates a cabinet for holding the information input portion 1602 and the display apparatus 1601.

According to the present invention, an current signal having an excellent quality can be generated. Further, display having an excellent quality can be realized thereby.

What is claimed is:

1. A current signal output circuit for outputting a current signal in accordance with an inputted voltage signal comprising:

a current signal control circuit, said current signal control circuit comprising:

at least a first through a sixth switch, a first and a second capacitor element and a first and a second transistor;

wherein a first terminal of the first switch is connected to a voltage signal line for providing the voltage signal, a second terminal of the first switch is connected to a first terminal of the first capacitor element, a second terminal of the first capacitor element is connected to a gate electrode of the first transistor, a first terminal and a second terminal of the third switch are respectively connected to the gate electrode and a second main electrode of the first transistor, a first main electrode of the first transistor is connected to a first power source, the second main electrode of the first transistor is connected to a first terminal of the fourth switch, a first terminal of the second switch is connected to the voltage signal line for providing the voltage signal and a second terminal of the second switch is connected to a first terminal of the second capacitor element, a second terminal of the second capacitor element is connected to a gate electrode of the second transistor, a first terminal and a second terminal of the fifth switch are respectively connected to a gate electrode and a second main electrode of the second transistor, a first main electrode of the second transistor is connected to the first power source, the second main electrode of the second transistor is connected to a first terminal of the sixth switch, second terminals of the fourth and the sixth switches are connected to each other to constitute a current signal output terminal for outputting the current signal, and control terminals of the first through the sixth switches are respectively connected to a first through a sixth control signal line.

2. A display apparatus comprising:

the current signal output circuit according to claim 1; and a plurality of display elements;

wherein said current signal output circuit successively supplies the current signal to the plurality of display elements.

3. The display apparatus according to claim 2, further comprising:

a plurality of sets each comprising the current signal output circuit and the plurality of display elements to which the current signal output circuit successively supplies the current signal;

wherein a matrix of the display elements is constituted by the display elements belonging to the respective sets, the current signal output circuit controls the matrix in a column direction thereof and includes a row control circuit for controlling the matrix in a row direction thereof.

4. The display apparatus according to claim 2, wherein the display element at least includes an electroluminescence element.

5. An information display apparatus comprising:

an information input portion; and the display apparatus according to claim 2 for displaying based on information inputted to the information input portion.

6. A display apparatus comprising:

the current signal output circuit according to claim 1; and a display element for receiving supply of a signal from an output signal of the current signal, a plurality of said display elements being arranged at a two dimensional region;

wherein the fourth and the sixth switches are selectively operated and operation of the fourth and sixth switches are changed by an odd number row or an even number row by a frame of a displayed image signal.

7. A display apparatus comprising:

a plurality of the current signal output circuits according to claim 1; and a plurality of display elements for outputting colors of light different from each other by receiving supply of a signal from the current signal output circuits;

wherein a group of three colors of image signals are inputted at least to the current signal output circuit as the voltage signal, a set is constituted by three of the current signal control circuits, and the current signals in correspondence with the respective colors of the image signals outputted from the set of current signal control circuits are outputted among three of the current signal control circuits included in the one set of current signal control circuits by a frame unit of the image signal.

8. A current signal output circuit for outputting a current signal in accordance with an inputted voltage signal comprising:

a current signal control circuit, said current signal control circuit comprising:

at least a first through an eighth switch, a first and a second capacitor element and a first through a fourth transistor;

wherein a first terminal of the first switch is connected to a voltage signal line for providing the voltage signal and a second terminal of the first switch is connected to a first terminal of the first capacitor element, a second terminal of the first capacitor element is connected to a gate electrode of the first transistor, a first terminal and a second terminal of the third switch are respectively connected to the gate electrode and a second main electrode of the first transistor, a first main electrode of the first transistor is connected to a first power source, the second main electrode of the first transistor is connected to a first terminal of the fourth switch and a first terminal of the seventh switch, a second terminal of the seventh switch is connected to a first main electrode of the third transistor, a gate electrode and the first main electrode or a second main electrode of the third transistor are shortcircuited and the second main electrode is connected to a second power source, a first terminal of the second switch is connected to the voltage signal line for providing the voltage signal, a second terminal of the second switch is connected to a first terminal of the second capacitor element, a second terminal of the second capacitor element is connected to a gate electrode of the second transistor, a first terminal and a second terminal of the fifth switch are respectively connected to the gate electrode and a second main electrode of the second transistor, a first main electrode of the second transistor is connected to the first power source, the second main electrode of the second transistor is connected to a first terminal of the sixth switch and a first terminal of the eighth switch, a second terminal of the eighth switch is connected to a first main electrode of the fourth transistor, a gate electrode and the first main electrode or a second main electrode of the fourth transistor are shortcircuited and the second main electrode is connected to a second power source, second terminals of the fourth and the sixth switches are connected to each other to constitute a current signal output terminal for outputting the current signal to outside, and control terminals of the first through the eighth switches are respectively connected to a first through an eighth control signal line.

9. The current signal output circuit for outputting a current signal in accordance with an inputted voltage signal according to claim 8, wherein said current signal output circuit is controlled such that a time period for conducting both of the third switch and the seventh switch are conducted and/or a time period for conducting both of the fifth switch and the eighth switch are present.

10. A current signal output circuit for outputting a current signal in accordance with an inputted voltage signal comprising:

a current signal control circuit, said current signal control circuit comprising:

at least a first and a second switch, a first capacitor element, and a first transistor;

wherein a first terminal of the first switch is connected to a voltage signal line for providing the voltage signal, a second terminal of the first switch is connected to a first terminal of the first capacitor element, a second terminal of the first capacitor element is connected to a gate electrode of the first transistor, a first terminal and a second terminal of the third switch are respectively connected to the gate electrode and a second main electrode of the first transistor, and a first main electrode of the first transistor is connected to a first power source, wherein the gate electrode of the first transistor is charged via the second switch and discharged such that a voltage of the gate electrode of the first transistor becomes proximate to a threshold voltage and thereafter, the gate electrode of the first transistor is charged to a voltage in accordance with the voltage signal provided to the first switch and the current signal in accordance with the charged state is outputted from the second main electrode as the current signal.

11. The current signal output circuit for outputting current signal in accordance with an inputted voltage signal according to claim 10, wherein the gate electrode is discharged such that a voltage of the gate electrode of the first transistor becomes proximate to a threshold voltage in a time period in which the voltage signal provided to the first switch is at a reference level.

12. A current signal output circuit comprising:

at least two of the current signal control circuits according to claim 10, wherein the gate electrode of the first transistor is charged to a voltage in accordance with the voltage signal in another of the current signal control circuits when the current signal is outputted in one of the current signal control circuits.

13. A display apparatus comprising:

the current signal output circuit according to claim 12; and a plurality of display elements;

wherein the current signal output circuit is constituted to successively supply the current signal to the plurality of display elements and controlled such that a corresponding relationship between at least two of current signal control circuits constituting the current signal output circuit and respective of the plurality of display elements is not fixed.

14. The display apparatus according to claim 13, further comprising:

a plurality of sets each comprising the current signal output circuit and the plurality of display elements to which the current signal output circuit successively supplies the current signal;

wherein a matrix of the display elements is constituted by the display elements belonging to the respective sets, the current signal output circuit controls the matrix in a column direction thereof and includes a row control circuit for controlling the matrix in a row direction thereof.

15. A display apparatus comprising:

the current signal output circuit according to claim 10; and a plurality of display elements;

wherein the current signal output circuit successively supplies the current signal to the plurality of display elements.

16. The display apparatus according to claim 15, wherein the display element includes at least an electroluminescence element.

17. An information display apparatus comprising:

an information input portion; and the display apparatus according to claim 15 for displaying based on information inputted to the information input portion.

18. The display apparatus according to claim 15, further comprising:

a plurality of sets each comprising the current signal output circuit and the plurality of display elements to which the current signal output circuit successively supplies the current signal;

wherein a matrix of the display elements is constituted by the display elements belonging to the respective sets, the current signal output circuit controls the matrix in a column direction thereof and includes a row control circuit for controlling the matrix in a row direction thereof.

19. A current signal output circuit for outputting a current signal in accordance with an inputted voltage signal comprising:

a current signal control circuit, said current signal control circuit comprising:

at least a first switch, a first capacitor element and a first transistor;

wherein a first terminal of the first switch is connected to a voltage signal line for providing the voltage signal, a second terminal of the first switch is connected to a first terminal of the first capacitor element, a second terminal of the first capacitor element is connected to a gate electrode of the first transistor, and the first main electrode of the first transistor is connected to a first power source, wherein the gate electrode is discharged such that a voltage of the gate electrode of the first transistor becomes proximate to a threshold voltage, thereafter the gate electrode of the first transistor is charged to a voltage in accordance with the voltage signal provided to the first switch and the current signal is outputted in accordance with the charged state from the second main electrode of the first transistor.

20. The current signal output circuit for outputting a current signal in accordance with an inputted voltage signal according to claim 19, wherein the gate electrode is discharged such that the voltage of the gate electrode of the first transistor becomes proximate to a threshold voltage during a timer period in which the voltage signal provided to the first switch is at a reference level.

21. A current signal output circuit comprising:

at least two of the current signal control circuits according to claim 19, wherein the gate electrode of the first transistor is charged to a voltage in accordance with the voltage signal in another of the current signal control circuits when the current signal is outputted in one of the current signal control circuits.

22. A display apparatus comprising:

the current signal output circuit according to claim 21; and a plurality of display elements;

wherein the current signal output circuit is constituted to successively supply the current signal to the plurality of display elements and controlled such that a corresponding relationship between at least two of current signal control circuits constituting the current signal output circuit and respective of the plurality of display elements is not fixed.

23. The display apparatus according to claim 22, further comprising:

a plurality of sets each comprising the current signal output circuit and the plurality of display elements to which the current signal output circuit successively supplies the current signal;

wherein a matrix of the display elements is constituted by the display elements belonging to the respective sets, the current signal output circuit controls the matrix in a column direction thereof and includes a row control circuit for controlling the matrix in a row direction thereof.

24. A display apparatus comprising:

the current signal output circuit according to claim 19; and a plurality of display elements;

wherein the current signal output circuit successively supplies the current signal to the plurality of display elements.

25. The display apparatus according to claim 24, further comprising:

a plurality of sets each comprising the current signal output circuit and the plurality of display elements to which the current signal output circuit successively supplies the current signal;

wherein a matrix of the display elements is constituted by the display elements belonging to the respective sets, the current signal output circuit controls the matrix in a column direction thereof and includes a row control circuit for controlling the matrix in a row direction thereof.

26. The display apparatus according to claim 24, wherein the display element includes at least an electroluminescence element.

27. An information display apparatus comprising:

an information input portion; and the display apparatus according to claim 24 for displaying based on information inputted to the information input portion.

28. An electroluminescence apparatus comprising:

a plurality of pixel circuits comprising an electroluminescence element, a driving transistor for providing driving current to drive the electroluminescence element and a capacitor connected to a gate of the driving transistor, and a column control circuit comprising a transistor, a first switch for providing a voltage signal to a gate of the transistor through a capacitor element, a switch means for connecting the gate of the transistor to a reference voltage source, and a second switch for providing a current signal to the plurality of pixel circuits from the transistor;

wherein the current signal provided to the pixel circuit from the column control circuit is held by a capacitor of the pixel circuit as a charging voltage, and the driving transistor provides the driving current to the electroluminescence element based on the charging voltage held by the capacitor;

wherein the column control circuit executes steps of:

inputting a voltage of blanking level to the capacitor element through the first switch while connecting the gate of the transistor to the reference voltage source by the switch means, inputting a video voltage through the first switch while disconnecting the gate of the transistor from the reference voltage source by the switch means so that a voltage is held by a gate capacitance of the transistor, and providing the current signal to the plurality of pixel circuits through the second switch according to the held voltage.

29. An electroluminescence apparatus according to claim 28, wherein the voltage of the blanking level is inputted to the capacitor element while short-circuiting a drain and the gate of the transistor by the switch means.

30. An electroluminescence apparatus comprising:

first and second pixel circuits, each of which comprising an electroluminescence element, a driving transistor for providing driving current to drive the electroluminescence element and a capacitor connected to a gate of the driving transistor;

a first column control circuit comprising a first transistor, a first switch for providing a voltage signal to a gate of the first transistor, and a second switch for providing a current signal to the first pixel circuit from the first transistor based on the voltage signal provided to the gate of the first transistor; and a second column control circuit comprising a second transistor, a third switch for providing a voltage signal to a gate of the second transistor and a fourth switch for providing a current signal to the second pixel circuit from the second transistor based on the voltage signal provided to the gate of the second transistor;

wherein the current signals provided to the first and second pixel circuits from the first and the second column control circuits are held by a capacitor of the pixel circuits as a charging voltage, and the driving transistor provides the driving current to the electroluminescence element based on the charging voltage held by the capacitor;

wherein the first and second column control circuits;

provides the current signal to the second pixel circuit through the fourth switch while providing a video signal to the gate of the first transistor through the first switch; and provides the current signal to the first pixel circuit through the second switch while providing a video signal to the gate of the second transistor through the third switch.

31. An electroluminescence apparatus according to claim 30, wherein the first or second column control circuit:

comprises a switch means and a capacitor element, and executes steps of:

inputting a voltage of blanking level to the capacitor element through the first or third switch while connecting the gate of the first or second transistor to the reference voltage source by the switch means, inputting a video voltage through the first or third switch while disconnecting the gate of the first or second transistor from the reference voltage source by the switch means so that a voltage is held by a gate capacitance of the first or second transistor, and providing the current signal to the first or second pixel circuit through the second or fourth switch according to the held voltage.

* * * * *

UNITED STATES PATENT AND TRADEMARK OFFICE

CERTIFICATE OF CORRECTION

PATENT NO. : 7,126,565 B2
APPLICATION NO. : 10/650776
DATED : October 24, 2006
INVENTOR(S) : Somei Kawasaki et al.

It is certified that error appears in the above-identified patent and that said Letters Patent is hereby corrected as shown below:

On Title Page item [73] ASSIGNEE:

"Canon, Kabushiki Kaisha" should read --Canon Kabushiki Kaisha--.

COLUMN 1:

Line 39, "signal 1a" should read --signal 11a--.

COLUMN 2:

Line 28, "150" should read --15D--

COLUMN 13:

Line 16, "MB," should read --M8,--.

COLUMN 14:

Line 8, "2F, 2F," should read --2E, 2F,--; and "21," should read --2L,--.
Line 40, "Ta1→lb1" should read --la1→lb1--.

COLUMN 15:

Line 20, "MB=OFF," should read --M8=OFF,--

COLUMN 17:

Line 44, "M10N" should read --M1 ON--.

COLUMN 18:

Line 61, "SPas" should read --SPa,--.

UNITED STATES PATENT AND TRADEMARK OFFICE

CERTIFICATE OF CORRECTION

PATENT NO. : 7,126,565 B2
APPLICATION NO. : 10/650776
DATED : October 24, 2006
INVENTOR(S) : Somei Kawasaki et al.

It is certified that error appears in the above-identified patent and that said Letters Patent is hereby corrected as shown below:

COLUMN 26:

Line 12, “circuits;” should read --circuits--.
Line 13, “provides” should read --provide--.
Line 17, “provides” should read --provide--.

Signed and Sealed this

Second Day of October, 2007

JON W. DUDAS
*Director of the United States Patent and Trademark Office*